US008458994B2

(12) United States Patent
Guschke et al.

(10) Patent No.: US 8,458,994 B2
(45) Date of Patent: Jun. 11, 2013

(54) METHOD OF SHIPPING A CHILD-RESISTANT MEDICATE CONTAINER

(75) Inventors: Thomas Guschke, Palm Beach Gardens, FL (US); Richard M. Lee, Volcano, CA (US)

(73) Assignee: Juno Technologies, LLC, Palm Beach Gardens, FL (US)

( * ) Notice: Subject to any disclaimer, the term of this patent is extended or adjusted under 35 U.S.C. 154(b) by 0 days.

(21) Appl. No.: 13/616,248

(22) Filed: Sep. 14, 2012

(65) Prior Publication Data

US 2013/0000258 A1 Jan. 3, 2013

Related U.S. Application Data

(63) Continuation of application No. 13/114,214, filed on May 24, 2011, now Pat. No. 8,359,816.

(60) Provisional application No. 61/347,898, filed on May 25, 2010.

(51) Int. Cl.

| | |
|---|---|
| ***B65B 61/00*** | (2006.01) |
| ***B65B 11/58*** | (2006.01) |
| ***B65B 9/02*** | (2006.01) |

(52) U.S. Cl.

USPC ..... 53/415; 53/449; 53/450; 53/469; 53/472; 53/474

(58) Field of Classification Search

USPC ..... 53/415, 449, 450, 452, 456–459, 53/467–469, 472, 474, 553

See application file for complete search history.

(56) References Cited

U.S. PATENT DOCUMENTS

| | | | |
|---|---|---|---|
| 349,761 | A | 9/1886 | Stebbins |
| 409,029 | A | 8/1889 | Elliott |
| 792,104 | A | 6/1905 | Woerner |
| 2,081,930 | A | 6/1937 | Hoffman |
| 2,086,534 | A | 7/1937 | Byrne |
| 2,103,520 | A | 12/1937 | Donnelly |
| 2,172,547 | A | 9/1939 | Ruth |
| 2,353,629 | A | 7/1944 | Apfelbaum |
| 2,426,911 | A | 9/1947 | Williamson |
| 2,492,864 | A | 12/1949 | Hermani |
| 2,580,096 | A | 12/1951 | Holt et al. |
| 2,631,763 | A | 3/1953 | Sutton |

(Continued)

OTHER PUBLICATIONS

Office Action Issued Dec. 8, 2010 in U.S. Appl. No. 12/823,238.

(Continued)

*Primary Examiner* — Stephen F Gerrity

(74) *Attorney, Agent, or Firm* — Panitch Schwarze Belisario & Nadel LLP

(57) ABSTRACT

A method of shipping at least one child-resistant medicate container via a carrier includes providing or obtaining at least one child-resistant medicate container including a front sidewall, and an opposing rear sidewall, a right sidewall, an opposing left sidewall, and at least one locking mechanism. The method also includes creating or obtaining a flat-rate shipping package from a carrier, inserting the at least one child-resistant medicate container into the package, and closing the package to enclose the at least one child-resistant medicate container within the package so that the package is generally flat and acceptable by the carrier for a flat-rate shipping. The method also includes causing the closed package to be shipped or transported by the carrier at a flat-rate.

12 Claims, 13 Drawing Sheets

U.S. PATENT DOCUMENTS

| | | | | | |
|---|---|---|---|---|---|
| D174,300 | S | | 3/1955 | Waterman | |
| 3,014,638 | A | * | 12/1961 | Farley | 53/415 |
| 3,058,586 | A | | 10/1962 | Touart | |
| 3,095,085 | A | | 6/1963 | Meijer | |
| 3,286,872 | A | | 11/1966 | Burdick, Jr. | |
| 3,305,145 | A | | 2/1967 | Tebbutt | |
| 3,355,067 | A | | 11/1967 | Espinal | |
| 3,678,884 | A | | 7/1972 | Robbins | |
| 3,788,517 | A | | 1/1974 | Eannarino et al. | |
| 3,863,804 | A | | 2/1975 | Infante-Diaz et al. | |
| 3,872,996 | A | | 3/1975 | Dogliotti | |
| 3,877,573 | A | | 4/1975 | Scott et al. | |
| 3,889,847 | A | | 6/1975 | Uroshevich et al. | |
| D238,469 | S | | 1/1976 | Lanois | |
| 4,113,098 | A | | 9/1978 | Howard | |
| D249,931 | S | | 10/1978 | Russert | |
| D249,932 | S | | 10/1978 | Russert | |
| 4,126,224 | A | | 11/1978 | Laauwe et al. | |
| 4,154,353 | A | | 5/1979 | Hoo | |
| 4,231,378 | A | | 11/1980 | Stevens | |
| 4,462,501 | A | | 7/1984 | Franchi | |
| 4,483,095 | A | | 11/1984 | Webinger | |
| D278,207 | S | | 4/1985 | McLaughlin | |
| 4,561,544 | A | | 12/1985 | Reeve | |
| 4,570,416 | A | * | 2/1986 | Shoenfeld | 53/415 |
| 4,591,074 | A | | 5/1986 | Kennings | |
| D286,506 | S | | 11/1986 | Poore et al. | |
| D298,512 | S | | 11/1988 | Gotlib | |
| 4,893,728 | A | | 1/1990 | Jennings et al. | |
| 4,913,284 | A | * | 4/1990 | Versaci | 53/415 |
| 4,971,203 | A | | 11/1990 | Weinstein | |
| 4,972,657 | A | | 11/1990 | McKee | |
| 5,080,222 | A | | 1/1992 | McNary | |
| 5,080,227 | A | | 1/1992 | Focke | |
| 5,082,137 | A | | 1/1992 | Weinstein | |
| D324,175 | S | | 2/1992 | Beck | |
| 5,099,999 | A | | 3/1992 | Balien | |
| 5,141,129 | A | | 8/1992 | Jennings | |
| 5,169,003 | A | | 12/1992 | Traupman | |
| D332,347 | S | | 1/1993 | Raadt et al. | |
| 5,209,349 | A | * | 5/1993 | Porter et al. | 53/472 |
| 5,275,291 | A | | 1/1994 | Sledge | |
| 5,285,897 | A | | 2/1994 | Ozaki | |
| 5,405,011 | A | | 4/1995 | Haber et al. | |
| 5,405,047 | A | | 4/1995 | Hansen | |
| 5,427,265 | A | | 6/1995 | Cautereels et al. | |
| D364,344 | S | | 11/1995 | Shaw | |
| D375,455 | S | | 11/1996 | Uhl et al. | |
| 5,579,933 | A | | 12/1996 | Hofmann | |
| 5,709,306 | A | | 1/1998 | Hofmann | |
| 5,718,347 | A | | 2/1998 | Walker et al. | |
| 5,918,758 | A | | 7/1999 | Galton-Fenzi | |
| 5,947,345 | A | | 9/1999 | Hofmann | |
| 6,036,021 | A | * | 3/2000 | Moi | 53/468 |
| D422,785 | S | | 4/2000 | Cavell | |
| 6,095,364 | A | | 8/2000 | Dickie et al. | |
| D453,680 | S | | 2/2002 | Grintz et al. | |
| 6,631,800 | B1 | | 10/2003 | Keeven | |
| D485,754 | S | | 1/2004 | Fielder et al. | |
| 6,672,471 | B2 | | 1/2004 | Cross | |
| 6,953,131 | B2 | | 10/2005 | Devine | |
| D513,584 | S | | 1/2006 | Solowiejko et al. | |
| D517,316 | S | | 3/2006 | Tagliati et al. | |
| D523,171 | S | | 6/2006 | Mitten et al. | |
| D523,743 | S | | 6/2006 | Solowiejko et al. | |
| D526,761 | S | | 8/2006 | Hoffman | |
| 7,114,619 | B2 | | 10/2006 | Ellis et al. | |
| 7,140,511 | B2 | | 11/2006 | Baker et al. | |
| D540,493 | S | | 4/2007 | Fick | |
| D540,664 | S | | 4/2007 | Richardson et al. | |
| D542,661 | S | | 5/2007 | Adler et al. | |
| D545,186 | S | | 6/2007 | Liebe et al. | |
| D549,573 | S | | 8/2007 | Liebe et al. | |
| D554,990 | S | | 11/2007 | Terrasi | |
| 7,311,205 | B2 | | 12/2007 | Adler et al. | |
| D568,736 | S | | 5/2008 | Born et al. | |
| 7,413,082 | B2 | | 8/2008 | Adler et al. | |
| D594,742 | S | | 6/2009 | Meier et al. | |
| D598,295 | S | | 8/2009 | Miceli et al. | |
| D606,307 | S | | 12/2009 | Gauss | |
| D607,320 | S | | 1/2010 | Tearle | |
| D614,025 | S | | 4/2010 | Paredes et al. | |
| 7,708,142 | B2 | | 5/2010 | Ehrlund | |
| D616,753 | S | | 6/2010 | Beam et al. | |
| D618,905 | S | | 7/2010 | Watson | |
| 7,757,843 | B2 | | 7/2010 | Katsis | |
| D627,222 | S | | 11/2010 | Oravez et al. | |
| D644,507 | S | | 9/2011 | Lee et al. | |
| D671,677 | S | | 11/2012 | Wu | |
| D671,678 | S | | 11/2012 | Wu | |
| 2002/0069619 | A1 | * | 6/2002 | Abasolo et al. | 53/449 |
| 2002/0129758 | A1 | | 9/2002 | Hanley et al. | |
| 2003/0193185 | A1 | | 10/2003 | Valley et al. | |
| 2005/0082178 | A1 | | 4/2005 | Draghetti et al. | |
| 2005/0199527 | A1 | * | 9/2005 | Ellis et al. | 206/540 |
| 2006/0218881 | A1 | * | 10/2006 | Sperry et al. | 53/450 |
| 2007/0250346 | A1 | * | 10/2007 | Luciano, Jr. et al. | 705/2 |
| 2007/0251983 | A1 | * | 11/2007 | Freeze | 229/125.125 |
| 2007/0284277 | A1 | | 12/2007 | Gnepper | |
| 2008/0011761 | A1 | | 1/2008 | Gnepper et al. | |
| 2009/0266837 | A1 | | 10/2009 | Gelardi et al. | |
| 2009/0319395 | A1 | * | 12/2009 | Chandaria | 705/26 |
| 2009/0321296 | A1 | | 12/2009 | Luciano, Jr. et al. | |
| 2011/0000814 | A1 | | 1/2011 | Lee et al. | |
| 2011/0000931 | A1 | | 1/2011 | Gelardi et al. | |
| 2011/0067363 | A1 | | 3/2011 | Sprada et al. | |

OTHER PUBLICATIONS

Office Action Issued Mar. 1, 2011 in U.S. Appl. No. 12/823,238.
Office Action Issued Nov. 8, 2011 in U.S. Appl. No. 12/823,238.
Office Action issued Apr. 27, 2012 in U.S. Appl. No. 13/372,700.
Office Action issued Jun. 15, 2012 in U.S. Appl. No. 13/114,214.
U.S. Appl. No. 29/435,571 by Lee, filed Oct. 25, 2012.
U.S. Appl. No. 29/435,578 by Lee, filed Oct. 25, 2012.
Office Action Issued May 16, 2011 in U.S. Appl. No. 29/384,860.
Office Action issued Feb. 15, 2013 in U.S. Appl. No. 29/435,578, 36 pages.

* cited by examiner

METHOD OF SHIPPING A CHILD-RESISTANT MEDICATE CONTAINER

CROSS-REFERENCE TO RELATED APPLICATIONS

The present application is a continuation of U.S. patent application Ser. No. 13/114,214, filed May 24, 2011, now U.S. Pat. No. 8,359,816, and entitled "Apparatus for and Method of Shipping a Child-Resistant Medicate Container," which claims priority to U.S. Provisional Patent Application No. 61/347,898, filed May 25, 2010 and entitled "Method of Shipping a Child-Resistant Medicate Container."

BACKGROUND OF THE INVENTION

The present invention relates generally to an apparatus for and method of shipping one or more child-resistant medicate containers and, more specifically, to a child-resistant medicate container that is configured to store and/or dispense medicate, such a pills, capsules, tablets and/or liquid medicine, and is sized and shaped for ease of shipping, packaging and/or transporting one or more containers in a relatively thin, flat-rate package.

Medicate or pharmaceutical products, such as pills, capsules, tablets and/or liquid medicine, are typically packaged in child-resistant medicate containers having a generally cylindrical base or housing with an open first end and an opposite closed second end. A cap or cover is rotatably mounted to the open end of the base and typically requires the user to perform a distinct finger and/or hand motion to remove the cap from the base. Unfortunately, conventional containers have several drawbacks. For example, the shape of cylindrical or circular child-resistant medicate containers makes it expensive and inefficient to ship, package and/or transport multiple containers in a single package. The cost of shipping or transporting the containers increases as the number or size of the packages increases. In addition, expensive specifically-designed packaging is necessary to properly hold the conventional medicate containers and often results in unused or wasted space within the packaging. Further, due to the shape of conventional child-resistant medicate containers, information labels can be difficult to properly apply to the base or cap. Furthermore, since conventional child-resistant medicate containers include two separable parts (i.e., the base and the cap), problems arise when a user inadvertently misplaces one of these components.

Therefore, it would be desirable to create a child-resistant medicate container and an apparatus for shipping same that eliminates the above-identified deficiencies of conventional child-resistant medicate containers. Specifically, it would be desirable to create a child-resistant medicate container that is generally flat and/or rectangular in shape such that multiple containers can be easily and/or conveniently placed inside a flat-rate box and/or packaging from a carrier without wasting space. Further, it would be desirable to create a child-resistant medicate container having substantially planer and/or flat surfaces, such that various labels can be easily and/or conveniently applied thereto. Furthermore, it would be desirable to create a child-resistant medicate container for holding and/or dispensing pharmaceutical products, in which the various components of the container cannot inadvertently be separated and/or removed from each other once the container is assembled. The present invention accomplishes the above objectives.

BRIEF SUMMARY OF THE INVENTION

Briefly stated, a preferred embodiment of the present invention is directed to a method of shipping at least one child-resistant medicate container via a carrier. The method includes providing or obtaining at least one child-resistant medicate container including a front sidewall, and an opposing rear sidewall, a right sidewall, an opposing left sidewall, and at least one locking mechanism. Each of the front and rear sidewalls defines a plane such that the plane of the front sidewall and the plane of the rear sidewall extend generally parallel to each other. Each of the right and left sidewalls define a plane such that the plane of the right sidewall and the plane of the left sidewall extend generally parallel to each other. The right sidewall extends generally perpendicularly to the front sidewall. The method also includes creating or obtaining a flat-rate shipping package from a carrier, inserting the at least one child-resistant medicate container into the package, and closing the package to enclose the at least one child-resistant medicate container within the package so that the package is generally flat and acceptable by the carrier for a flat-rate shipping. The method also includes causing the closed package to be shipped or transported by the carrier at a flat-rate.

In another aspect, a preferred embodiment of the present invention is directed to a method of shipping at least two child-resistant medicate containers via a carrier. The method includes providing or obtaining at least two child-resistant medicate containers including a front sidewall, an opposing rear sidewall, a right sidewall, an opposing left sidewall, and at least one locking mechanism. Each of the front and rear sidewalls defines a plane such that the plane of the front sidewall and the plane of the rear sidewall extend generally parallel to each other. Each of the right and left sidewalls define a plane such that a plane of the right sidewall and the plane of the left sidewall extend generally parallel to each other. The right sidewall extends generally perpendicularly to the front sidewall. The method includes at least partially filling each of the at least two child-resistant medicate containers with a specified type and specified amount of medicament, dispensing or laying a first packaging material on a surface, placing each of the at least two child-resistant medicate containers onto the first packaging material, spacing apart each of the at least two child-resistant medicate containers on the first packaging material by a pre-determined distance, and dispensing or laying a second packaging material to at least partially cover each of the at least two child-resistant medicate containers between the first and second packaging material. The method further including sealing the first and second packaging material together to form a close package that encloses each of the at least two child-resistant medicate containers therebetween, and causing the closed package to be shipped or transported by the carrier at a flat-rate.

In yet another aspect, a preferred embodiment of the present invention is directed to an apparatus for shipping or transporting at least one child-resistant medicate container via a carrier at a flat-rate. The apparatus includes a top surface and an opposing bottom surface. The top and bottom surfaces each define a plane such that the plane of the top surface and the plane of the bottom surface extend generally parallel to each other. The top and bottom surface are spaced-apart at pre-determined distance. The apparatus includes a front sidewall and an opposing rear sidewall. The front and rear sidewalls each define a plane such that the plane of the front sidewall and the plane of the rear sidewall extend generally parallel to each other. The planes defined by the front and rear sidewalls extend generally perpendicularly to the planes defined by the top and bottom surfaces. The apparatus includes a right sidewall and an opposing left sidewall. The right and left sidewalls each define a plane such that the plane of the right sidewall and the plane of the left sidewall extend generally parallel to each other. The planes defined by the right and left sidewalls extend generally perpendicularly to the planes defined by the top and bottom surfaces and the front and rear side walls. The apparatus also includes one opening extending through the top surface. The at least one opening is sized and shaped to receive at least a portion of at least one child-resistant medicate container therein.

In yet another aspect, a preferred embodiment of the present invention is directed to a combination of at least one child-resistant medicate container and an apparatus for shipping or transporting the at least one child-resistant medicate container via a carrier at a flat-rate. The combination includes the at least one child-resistant medicate container with the housing having an open first end and an opposing closed second end. The housing at least partially encloses a storage cavity. The housing includes a top segment fixedly attached to and extending from a bottom segment. A portion of the bottom segment is located proximate the close end of the housing and a portion of the top segment is located proximate the open first end of the housing. Each of the bottom segment and the top segment includes a generally flat first sidewall and an opposing generally flat second sidewall that define the storage cavity. Each sidewall defines a plane and each plane extends generally parallel with respect to the remaining planes. The planes defined by the first and second sidewalls of the bottom segment are spaced-apart a greater distance than the distance between the planes defined by the first and second sidewalls of the top segment. The at least one child-resistant medicate container includes a cover movable attached to the housing and surrounding at least a portion and second sidewalls of the top segment of the housing. One of the cover and the top segment of the housing includes an aperture formed in a sidewall thereof. The cover is movable between a first position in which the aperture is substantially blocked to prevent the medicate from being dispensed from the at least one child-resistant medicate container and a second position in which the aperture is at least partially open to allow the medicate to be dispensed from the at least one child-resistant medicate container. The apparatus includes a top surface and an opposing bottom surface. The top and bottom surfaces each define a plane such that the plane of the top surface and the plane of the bottom surface extend generally parallel to each other. The top and bottom surface are spaced-apart at pre-determined distance. The apparatus includes a front sidewall and an opposing rear sidewall. The front and rear sidewalls each define a plane such that the plane of the front sidewall and the plane of the rear sidewall extend generally parallel to each other. The planes defined by the front and rear sidewalls extend generally perpendicularly to the planes defined by the top and bottom surfaces. The apparatus includes a right sidewall and an opposing left sidewall. The right and left sidewalls each define a plane such that the plane of the right sidewall and the plane of the left sidewall extend generally parallel to each other. The planes defined by the right and left sidewalls extend generally perpendicularly to the planes defined by the top and bottom surfaces and the front and rear side walls. The apparatus also includes one opening extending through the top surface. The at least one opening is sized and shaped to receive at least a portion of at least one child-resistant medicate container therein.

BRIEF DESCRIPTION OF THE SEVERAL VIEWS OF THE DRAWINGS

The foregoing summary, as well as the following detailed description of preferred embodiments of the present invention, will be better understood when read in conjunction with the appended drawings. For the purpose of illustrating the present invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 2:
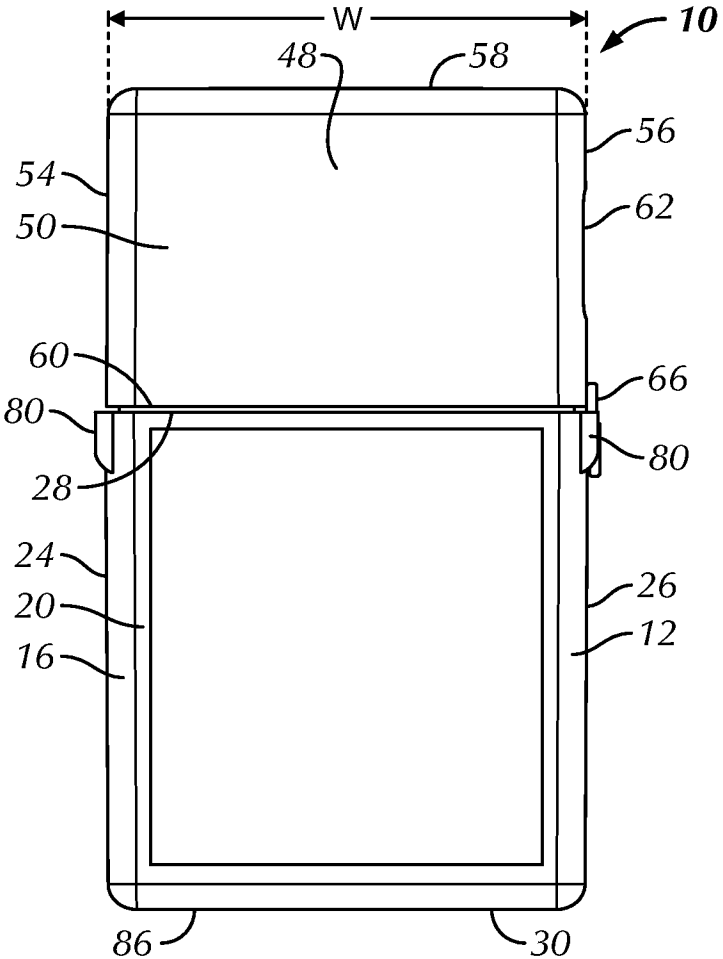
FIG. 2 is an front elevational view of the child-resistant medicate container shown in FIG. 1, with the cover in the first or storage position.

Certain terminology is used in the following description for convenience only and is not limiting. The words "right," "left," "lower," "upper," "top" and "bottom" designate directions in the drawings to which reference is made. The words "first" and "second" designate an order of operations in the drawings to which reference is made, but do not limit these steps to the exact order described. The words "inwardly" and "outwardly" refer to directions toward and away from, respectively, the geometric center of the container and designated parts thereof. Additionally, the terms "a," "an" and "the," as used in the specification, mean "at least one." The terminology includes the words above specifically mentioned, derivatives thereof, and words of similar import.

Referring to the drawings and detail, wherein like numerals indicate like elements throughout, there is shown in FIGS. 1-9 a first preferred embodiment of a child-resistant medicate container, generally designated 10 and hereinafter referred to as the "container" 10 in accordance with the present invention. The container 10 is preferably sized and shaped to hold, store, transport and/or dispense medicate or pharmaceutical products (not shown in FIGS. 1-9, but see the medicate 211 shown in FIG. 24), such as pills, tablets, capsules (i.e., oral solids) and/or liquid medicine or the like. Although the container 10 is preferably generally resistant to being opened by a child, as described in detail below, it is understood by those skilled in the art that the container 10 is not so limited, and may simply be a container designed to be openable by a user of any age.

Those of ordinary skill in the art will appreciate from this disclosure that the item(s) and/or contents to be held within the container 10 can be something other than the pills, tablets, capsules and/or liquid discussed above. For example, granular pharmaceuticals, contact lenses suspended in liquid, dental implant components (i.e., screws, inserts, etc.), small hardware and/or electronic parts, cosmetics or similar items potentially hazardous to children or adults can be safely contained in a relatively accessible and convenient manner using the container 10 of the present invention. Likewise, candies, breath mints or any relatively small item generally needing singular dispensing may be stored within the container 10. Thus, the container 10 can be used to contain other contents without departing from the spirit and scope of the present invention.

The container 10 is preferably formed of a high-strength, light-weight material, such as an opaque, translucent, amber or transparent die-formable polymeric material. For example, the container 10 may be formed of polypropylene, polyethylene terephthalate, polycarbonate, acrylic or styrene. However, a wide variety of materials, including but not limited to metals, such as aluminum and stainless steel may be used without departing from the scope and spirit of the invention. To preserve and/or protect the at least one item stored inside the container 10, the material used to form the container 10 is also preferably generally impenetrable and/or resistant to ultraviolet (U.V.) light.

Referring to FIGS. 1-9, the container 10 preferably includes a housing 12, having a generally flat or rectangular shape, that at least partially encloses a storage cavity 14 to hold the pharmaceutical product(s). Preferably, the rectangular-shaped housing 12 has first, second, third, and fourth corners, each of which have a generally arcuate shape and a generally equal radius of curvature. Those of ordinary skill in the art understand that the generally rectangular or square shape of the container 10 is more efficient for shipping/transporting and automated manufacturing than cylindrical or circular containers. The generally flat or rectangular shape of the container 10 is also more efficient than conventional vials for automated dispensing and handling using robotics and/or automated machines/equipment like A-frames and remote dispensing cabinets, for example. Further, with pre-counted quantities, the container 10 is more efficient for prescription or medicine filling because it eliminates the need for the pharmacy technician or pharmacist to hand-count the medicates, which is one of the major labor components in regular prescription or medicine fulfillment. The housing 12 preferably includes an open first end 84 and an opposing closed second end 86.

Figure 6:
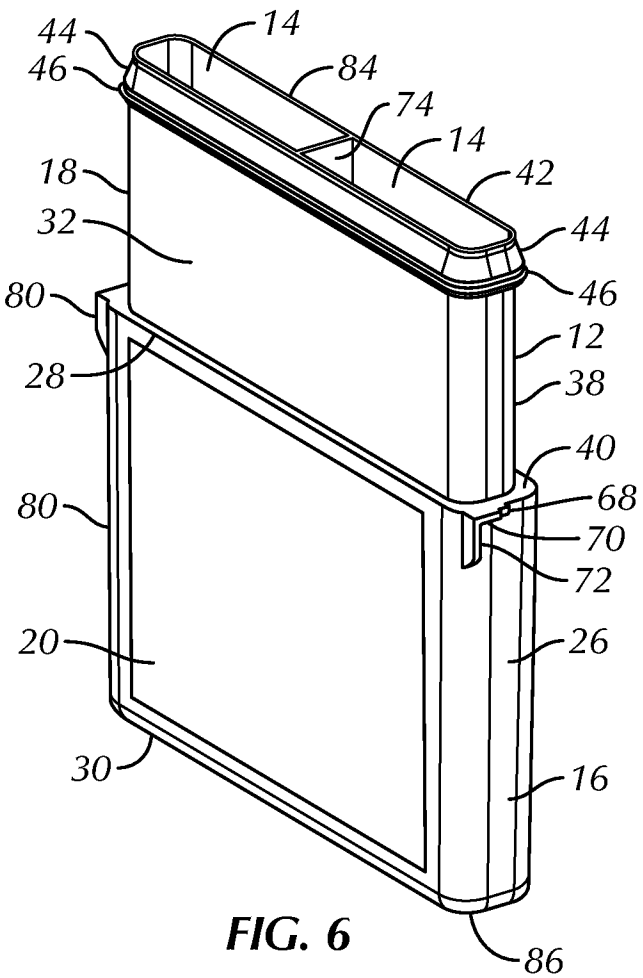
FIG. 6 is a perspective view of a housing of the child-resistant medicate container shown in FIG. 1.
Figure 5:
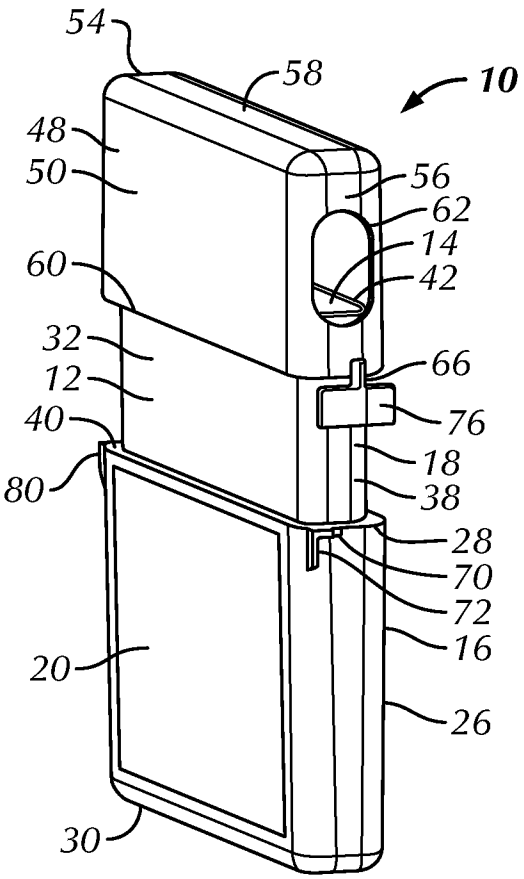
FIG. 5 is a perspective view of the child-resistant medicate container shown in FIG. 1, with the cover in a second or dispensing position.

The housing 12 includes a bottom or base segment 16 preferably fixedly attached to a top or insert segment 18. The base segment 16 includes a front sidewall 20, an opposing rear sidewall 22, a right sidewall 24 and an opposing left sidewall 26. In the preferred embodiment, the front and rear sidewalls 20, 22 are generally planer or flat along an entire width thereof and define two spaced-apart and generally parallel planes. The right and left sidewalls 24, 26 are preferably generally concave in shape along their width and define two spaced-apart and generally parallel planes. However, as seen in FIGS. 5 and 6, a central portion or midpoint of the left and right sidewalls 24, 26 may include a generally flat or planar portion. Thus, at least a portion of each of the right and left sidewalls 24, 26, such as the generally flat or planar portion, extends generally perpendicularly to the front and rear sidewalls 20, 22. Further, the base segment 16 includes a first end 28 and an opposing closed second or bottom end 30.

In the present embodiment, the flat, rectangular shape of the front and rear sidewalls 20, 22 are ideal for receiving one or more labels (not shown). For example, the front sidewall 20 may receive a label concerning the type of product held within the container 10 and/or an advertisement, and the rear sidewall 22 may receive a label concerning patient-specific information, such as dosage rate.

Figure 3:
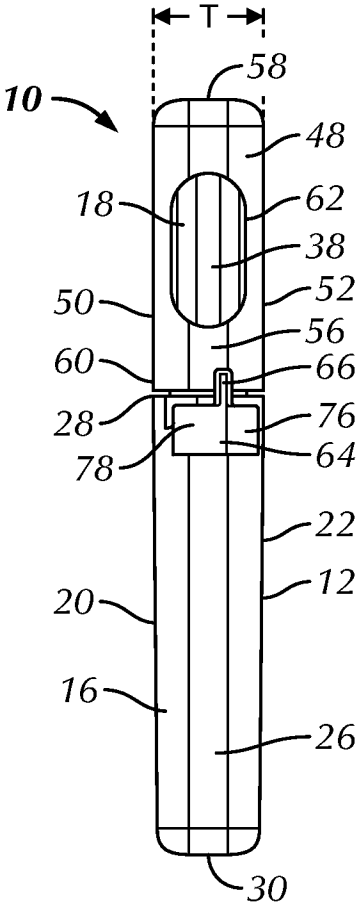
FIG. 3 is a left side elevational view of the child-resistant medicate container shown in FIG. 1, with the cover in the first or storage position.

As seen in FIG. 3, an exterior surface of the front and rear sidewalls 20, 22 of the base segment 16 define a maximum thickness "T" of the container 10. In the present embodiment, the maximum thickness "T" of the container 10, as measured from the exterior surface of the front sidewall 20 of the base segment 16 to the exterior surface of the rear sidewall 22 of the base segment 16, is preferably less than one half (½) inch. This dimensioning is necessary to assure that the container 10 fits in certain sized flat-rate packages. However, it is understood by those of ordinary skill in the art that the container 10 is not limited to this exact dimensioning.

Figure 8:
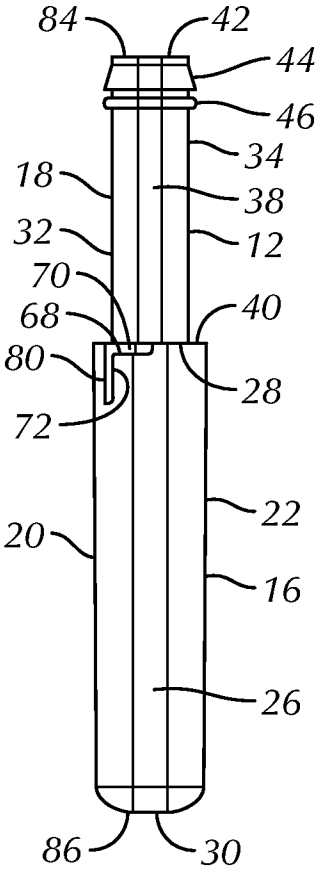
FIG. 8 is a left side elevational view of the housing shown in FIG. 6.

Referring to FIGS. 3-8, the top or insert segment 18 preferably extends from and is integrally and unitarily formed with and/or fixedly attached to the first end 28 of the base segment 16. Similar to the base segment 16, the insert segment 18 includes a front sidewall 32, an opposing rear sidewall 34, a right sidewall 36 and an opposing left sidewall 38. Similar to the base segment 16, the front and rear sidewalls 32, 34 of the insert segment 18 are generally planer or flat along an entire width thereof and define two-spaced apart and generally parallel planes. However, as shown in FIGS. 5, 6 and 8, the generally vertical planes defined by the front and rear sidewalls 32, 34 of the insert segment 18 are generally closer than the planes defined by the front and rear sidewalls 20, 22 of the base segment 16, such that a ledge or lip 40 is defined generally at the first end 28 of the base segment 16 or the point at which the insert segment 18 is fixedly attached to the base segment 16. The ledge 40 preferably extends inwardly generally perpendicularly from each of the front, rear, right and left sidewalls 20, 22, 24, 26 of the base segment 16 around the periphery of the container 10.

Furthermore, the right and left sidewalls 36, 38 of the insert segment 18 are generally concave in shape across a width thereof and generally define two spaced-apart and generally parallel planes. However, as shown in FIGS. 5 and 6, a central portion or midpoint of the right and left sidewalls 36, 38 may include a generally flat or planar portion. Thus, at least a portion of each of the right and left sidewalls 36, 38 of the insert segment 18, such as the generally flat or planar portion, generally extends perpendicularly to the front and rear sidewalls 32, 34 of the insert segment 18, similar to the sidewalls of the base segment 16. Further, a first or top end 42 of the insert segment 18 is generally open and provides access to the storage cavity 14 of the container 10.

Figure 7:
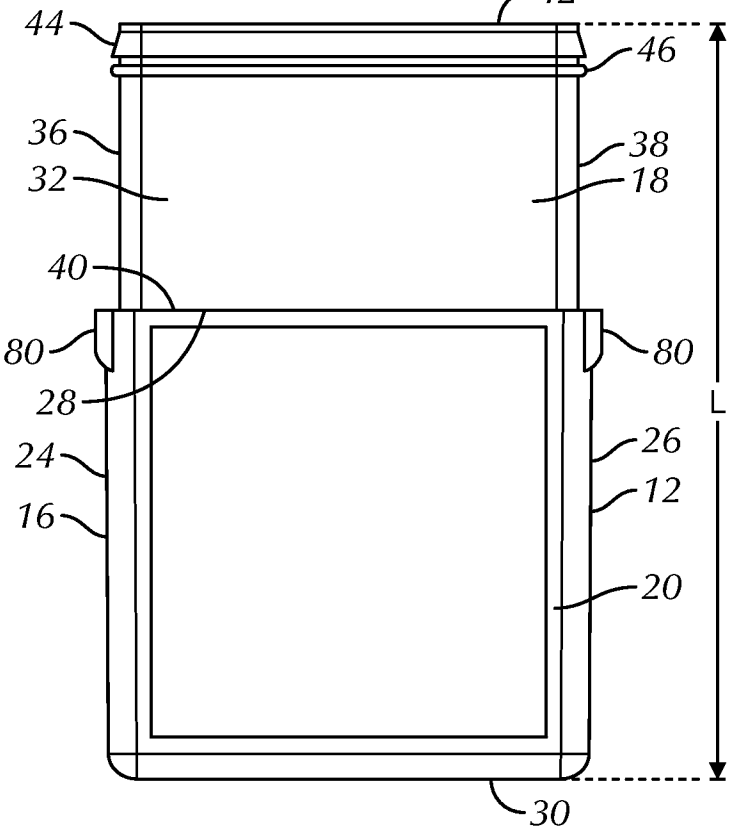
FIG. 7 is a front elevational view of the housing shown in FIG. 6.

Referring to FIGS. 6-8, the first end 42 of the insert segment 18 preferably includes a protuberance or catch 44, at least a portion of which extends generally perpendicularly from at least one of the sidewalls 32, 34, 36, 38 of the insert segment 18. The protuberance 44 is preferably molded to, and thus integral with, the insert segment 18. Preferably, the protuberance 44 generally defines an increasingly sloped surface extending away from the first end 42 of the insert segment 18 and extends circumferentially around an entire outer periphery of the insert segment 18. In the present embodiment, an elastomeric member 46, such as an O-ring, extends around the entire outer periphery of the insert segment 18 adjacent to or below the protuberance 44. Preferably, the elastomeric member 46 is fixedly attached, such as by being elastically biased, to each sidewall 32, 34, 36, 38 of the insert segment 18, but is understood that the elastomeric member 46 may be omitted or removably mounted to the insert segment 18.

Figure 1:
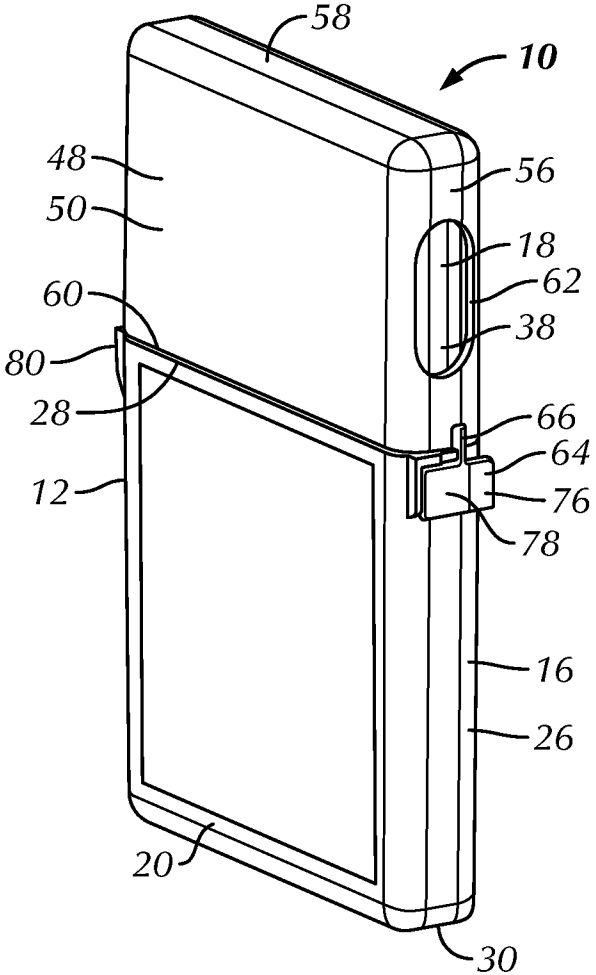
FIG. 1 is a perspective view of a child-resistant medicate container in accordance with a first preferred embodiment of the present invention, with a cover of the container shown in a first or storage position.
Figure 4:
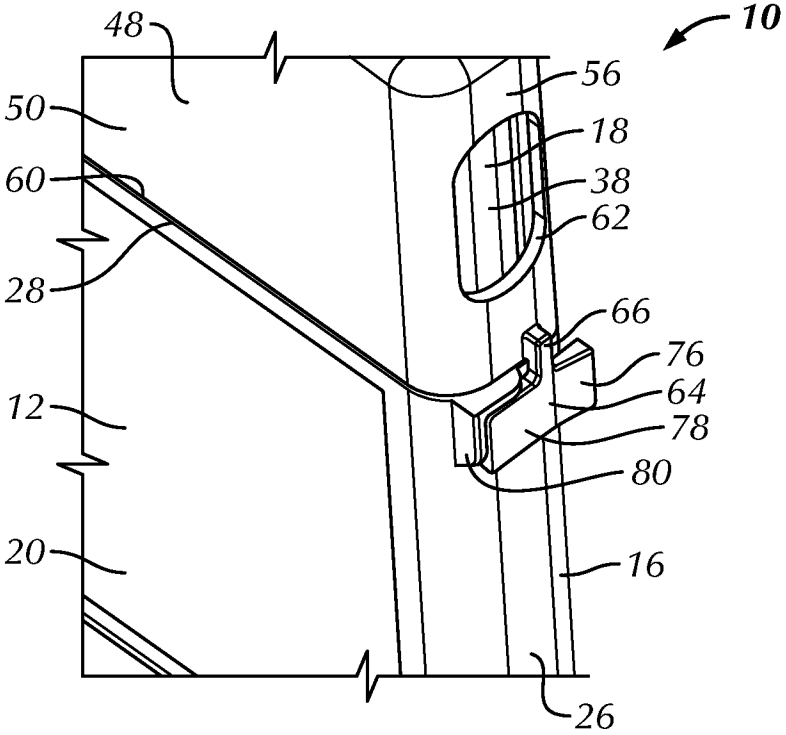
FIG. 4 is an enlarged perspective view of a portion of the child-resistant medicate container shown in FIG. 1, with the cover in the first or storage position.

Referring to FIGS. 1-5, the container 10 preferably includes a cap or cover 48 movably attached to the housing 12. In the preferred embodiment, the cover 48 surrounds and/or encloses at least a portion of the insert segment 18, such as the first end 42 of the insert segment 18. As will be described in detail below, the cover 48 is slidably, but preferably not removably, mounted to the insert segment 18. Thus, the container 10 includes less pieces for a user or consumer to misplace or loose. Similar to the base and insert segments 16, 18, the cover 48 includes a front sidewall 50, an opposing rear sidewall 52, a right sidewall 54, and an opposing left sidewall 56. Similar to the base and insert segments 16, 18, the front and rear sidewalls 50, 52 of the cover 48 are generally flat or planer in shape across an entire width thereof and define two spaced-apart and generally parallel planes. The right and left sidewalls 54, 56 of the cover 48 are generally concave along an entire width thereof. However, as shown in FIGS. 1, 4 and 5, a central portion or midpoint of the right and left sidewalls 54, 56 may include a generally flat or planar portion. Thus, at least a portion of each of the right and left sidewalls 54, 56 of the cover 48, such as the generally flat or planar portion, extends generally perpendicularly with respect to the front and rear sidewalls 50, 52 of the cover 48. The cover 48 further includes a first or top closed end 58 and an opposite second or bottom open end 60.

As shown in FIG. 7, a maximum length "L" of the container 10 is generally defined from the first end 42 of the insert segment 18 or first end 58 of the cover 48 (when the container10 is in the first or storage position) to the bottom end 30 of the base segment 16. It is understood by those skilled in the art that since the top end 58 and sidewalls 50, 52, 54, 56 of the cover 48 are preferably formed of a relatively thin yet high strength material, the difference in the maximum length "L" of the container 10 when the cover 48 is attached to the housing (FIG. 1) and when the cover 48 is removed from the housing (FIG. 7) is small. In the present embodiment, the maximum length "L" of the container 10 is preferably no greater than approximately 90 mm or approximately three and one half (3½) inches. This dimensioning is necessary to assure that the container 10 fits in certain sized flat-rate packages. However, it is understood by those of ordinary skill in the art that the container 10 is not limited to this exact dimensioning.

In the present embodiment, the cover 48 is sized and shaped to receive and/or enclose the insert segment 18. Specifically, the planes defined by the front and rear sidewalls 50, 52 of the cover 48 are spaced-apart at a predetermined distance that is generally equal to or slightly greater than the predetermined distance between the planes defined by the front and rear sidewalls 20, 22 of the base segment 18. Thus, the maximum thickness "T" between an exterior surface of the front sidewall 50 of the cover 48 and an exterior surface of the rear sidewall 52 of the cover 48 is generally equal to that defined by the exterior surfaces of front and rear sidewalls 20, 22 of the base segment 16. Additionally and/or alternatively to the label(s) described above, the container 10 may also include a tamper resistant (T.R.) label (not shown) that covers a portion of both or extends over/to the base segment 16 and the cover 48 in the first or storage position (FIGS. 1-4). Furthermore, a separate label may be applied or affixed entirely or only to one of the front and rear sidewalls 50, 52 of the cover 48, such that labels do not overlap. In other words, the container 10 may include at least three separate and distinct labels, each displaying different images and/or information.

As shown in FIGS. 1 and 3-5, the cover 48 preferably includes an aperture or opening 62 formed in a sidewall thereof. In the present embodiment, the aperture 62 is preferably formed in the left sidewall 56 of the cover 48. However, it is understood by those skilled in the art that the aperture 62 could be formed in any sidewall 50, 52, 54, 56 of the cover 48 and/or the first end 58 of the cover 48. Alternatively, an aperture (not shown) may be formed in a sidewall 32, 34, 36, 38 of the insert segment 18. The cover 48 may even include two or more apertures (not shown), but the cover 48 is not limited to the inclusion of one or more apertures. A tamper-resistant layer or foil (not shown) may be placed over the aperture 62 after filling the container 10 at the packaging facility. For example, the layer may be attached by adhesive or friction-fitted to a portion of the cover 48 that surrounds or covers the aperture 62 or the open first end 84 of the housing 12. The layer preferably forms an air-tight seal in a closed or un-ruptured position. It is preferred that the layer is destroyed, ruptured or at least temporarily opened when the cover 48 is slid or moved to a second, dispensing or open position (FIG. 5). The layer may be selectively resealed or reestablished when the cover 48 is returned to a first, storage or closed position (FIGS. 1-4).

Referring to FIGS. 1-5, a locking mechanism 64 is preferably attached to at least one of the housing 12, such as the base segment 18, and the cover 48. In the present embodiment, the locking mechanism 64 includes a flexible tab or living hinge pivotably attached to the cover 48 proximate the second end 60. Specifically, the flexible tab is rectangular in shape when viewed from the side (FIG. 3) and extends from and/or below the second end 60 of the cover 48 by a link member 66. The flexible tab is preferably biased in the locking position. In operation, depressing a first or proximate portion 76 of the flexible tab toward the housing 12 causes a second or distal portion 78 of the flexible tab to pivot away from the base segment 16 of the housing 12. Although not shown, the locking mechanism 64 may include two flexible tabs, one pivotably attached to the right sidewall 54 of the cover 48 proximate the second end 60 and a second pivotably attached to the left sidewall 56 of the cover 48 proximate the second end 60.

Figure 9:
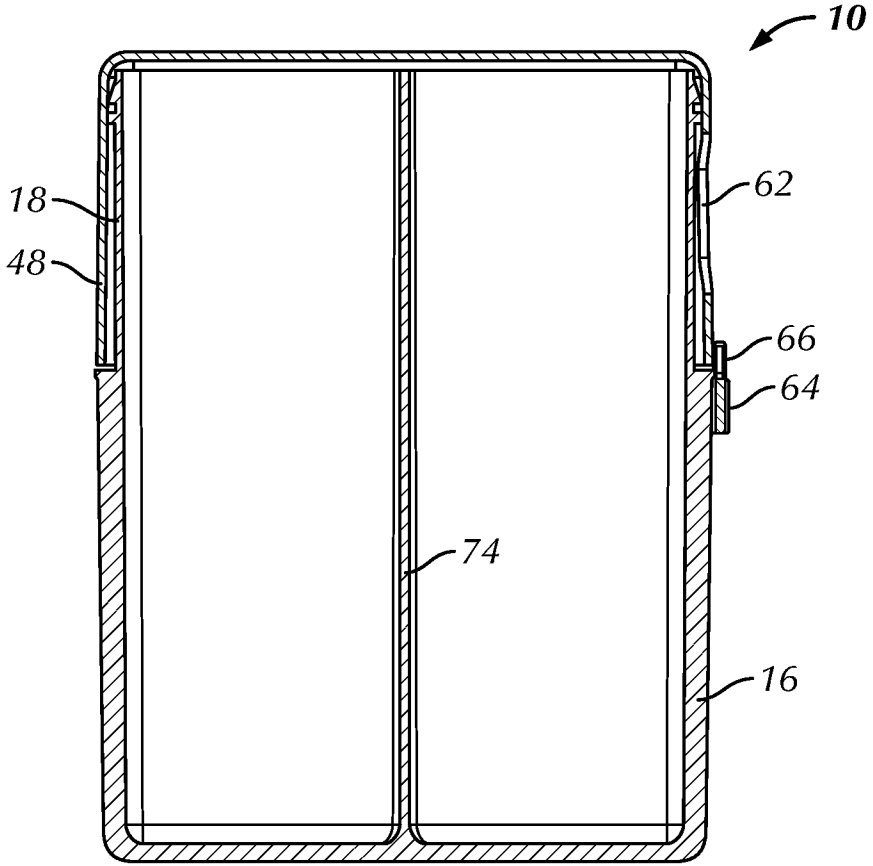
FIG. 9 is a cross-sectional elevation view of another preferred embodiment of the child-resistant medicate container shown in FIG. 1.

As shown in FIGS. 5-8, the housing 12 preferably includes a locking groove, indentation or notch 68 that is sized, shaped and located to receive at least a portion of the locking mechanism 64. Specifically, in the present embodiment, both the right and left sidewalls 24, 26 of the base segment 16 include a locking groove 68 proximate to and/or just below the first end 28 of the base segment 16. In the present embodiment, each locking groove 68 includes a first or horizontal portion 70 that extends generally horizontally and/or generally parallel to the ledge 40 and a second or vertical portion 72 that extends generally vertically and/or perpendicularly from one end of the first portion 70. In addition, a tab 80 preferably extends generally perpendicularly from the right and left sidewalls 24, 26 of the base segment 16 proximate the locking groove 68. In the preferred embodiment, the tab 80 provides additional structure for the flexible tab of the locking mechanism 64 to engage. FIG. 9 shows the embodiment where the container 10 includes only a single locking mechanism and locking groove 68.

As shown in FIG. 2, a maximum width "W" of the container 10 is generally defined between an exterior surface of the right sidewall 54 of the cover 48 and an exterior surface of the left sidewall 56 of the cover 48. It is understood by those skilled in the art that since the tab(s) 80 is/are relatively small compared to the width of the front and rear sidewalls 50, 52 of the container 10, the difference in the maximum width "W" of the container 10 that includes the tab(s) 80 and the maximum width "W" of the container 10 without the tab(s) 80 is small. In the present embodiment, the maximum width "W" of the container 10 is preferably no greater than approximately 70 mm or two and three fourth (2¾) inches. This dimensioning is necessary to assure that the container 10 fits in certain sized flat-rate packages. However, it is understood by those of ordinary skill in the art that the container 10 is not limited to this exact dimensioning.

In operation, the cover 48 is movable, and preferably slidable, between the first, storage or closed position (FIGS. 1-4), in which the aperture 62 is substantially blocked by a sidewall 32, 34, 36, 38 of the insert segment 18 to prevent the at least one item stored/held within the storage cavity 14 from being dispensed through the aperture 62 and from the container 10, and the second, dispensing or open position (FIG. 5), in which the aperture 62 is at least partially open to allow the at least one item stored/held within the storage cavity 14 to be dispensed through the aperture 62 and from the container 10. The slidable, but preferably not removably, feature of the cover 48 provides the user with greater control of the size of the aperture 62 when dispensing at least one item therefrom.

As understood by those of ordinary skilled in the art, the locking mechanism 64 generally locks the cover 48 in the first position (FIGS. 1-4) and provides the child-resistant feature of the container 10 such that the user must depress one or both locking mechanisms 64 (depending on the particular embodiment), generally with a thumb and index finger, and then slide the cover toward the second position (FIG. 5) to dispense the contents from within the container 10. Further, as understood by those skilled in the art, the protuberance 44 of the insert segment 18 generally prevents the cover 48 from being inadvertently removed from the insert segment 18 in the second position (FIG. 5).

An inside surface of one of the sidewalls 50, 52, 54, 56 of the cover 48 may include a complimentary hook or catch (not shown) to engage the protuberance 44 of the insert segment 18. Of course, it is likely that the cover 48 could be removed from the insert segment 18 if the user so desires, but doing so may result in at least a portion of the container 10 being destroyed, deformed, or caused to exceed its elastic flow limit in such an event. Further, the combination of the protuberance 44 and the elastomeric member 46 may form a moisture-tight seal or barrier between the insert segment 18 and the cover 48 in the first position (FIGS. 1-4) such that the container 10 preserves the contents therein and is capable of properly holding/storing liquids.

As shown in FIGS. 6 and 9, the housing 12 may include a rib 74, which generally connects an inner surface of the front sidewalls 20, 32 of the base and insert segments 16, 18 to the rear sidewalls 22, 34 of the base and insert segments 16, 18. The rib 74 provides increased stiffness to the housing 12 during the forming of the container 10. Preferably, the rib 74 defines a plane that is spaced a predetermined distance apart from and generally parallel to each of the planes defined by the right and left sidewalls 24, 36, 26, 38 of the base and insert segments 16, 18, respectively. As shown in FIG. 9, the rib 74 may extend the entire length within storage cavity 14 or the interior of the housing 12, such that the rib 74 extends from the second end 30 of the base segment 16 to the first end 42 of the insert segment 18. However, it is understood by those skilled in the art that the housing 12 is not limited to the inclusion of the stiffening rib 74 and the stiffening rib 74 may be modified in size, shape and/or location. Specifically, the rib 74 may be spaced a predetermined distance away from one or both of the first end 42 of the insert segment 18 and the second end 30 of the base segment 16. Alternatively, the rib 74 may be located on the exterior surface one or more of at least a portion of the sidewalls of the base segment 16 and/or insert segment 18 to help keep the housing 12, and thus the storage cavity 14, generally uniform during the forming process.

As shown in FIGS. 10-18 and 19B, the above-identified structural and operation features of the container 10 provide for an inexpensive and convenient method of shipping, packaging and/or transporting at least one, and preferably two or more, child-resistant containers via a carrier or courier service, such as the U.S. Postal Service, Fed-Ex or UPS. The method preferably includes the steps of providing one and preferably at least two child-resistant containers 10 and obtaining or constructing a flat-rate shipping package allowed and/or approved by the carrier. The term "flat-rate shipping package" is defined herein as any packaging approved, allowed, provided and/or sold by a carrier in which the carrier charges a predetermined rate to ship the package, irrespective of the weight of the contents, as long as the contents properly fit within the package.

Figure 10:
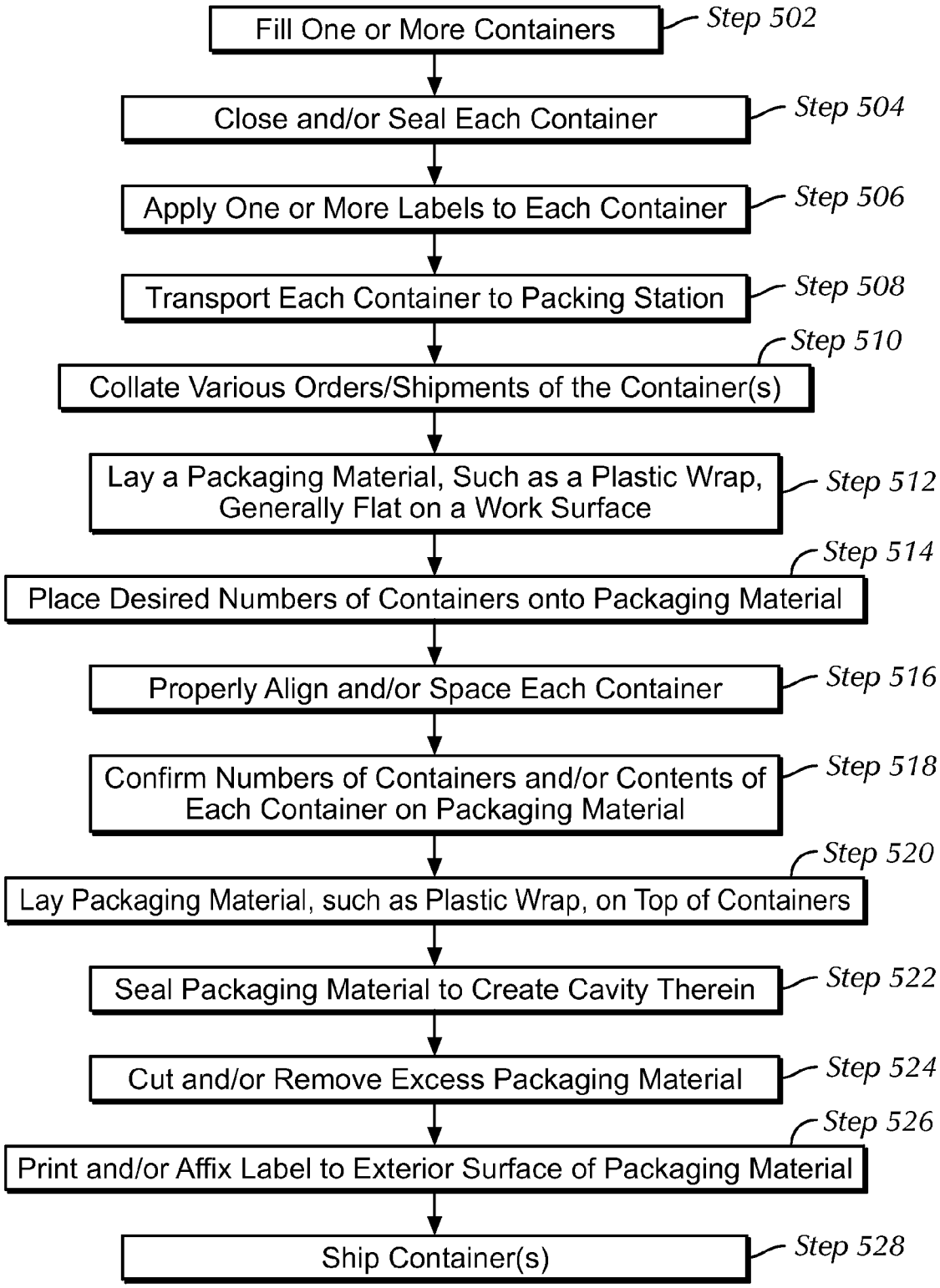
FIG. 10 is a flow diagram of a method of shipping one or more child-resistant medicate containers in accordance with a preferred embodiment of the present invention.

In particular, the method of shipping the container(s) 10 preferably includes the steps illustrated in the flow diagram of FIG. 10. For example, initially, it is preferred that one or more child-resistant containers 10 are filled to a desired amount and a desired type of medicate (Step 502). The housing 12 of each container 10 is preferably filled with the specified medicate via a robot (not shown) or other automated process. However, the housing 12 may be filled with the desired medicate by an individual. The cover 48 is preferably then attached to the housing 12 to enclose and/or seal the medicate within the storage cavity 14 such that the cover 48 is in the first or closed position (Step 504). Next, it is preferred that one or more labels are applied to the exterior of the housing 12 and/or cover 48 of each container 10 (Step 506). As described above, three of more distinct labels may be applied to the container 10 in a spaced-apart relation such that none of the labels overlap.

It is preferred that the two or more child-resistant containers 10 that are filled with medicate are moved or transferred, for example via a conveyor belt 88 (FIGS. 11-13), a vehicle or are hand-carried to a preferably separate location, such as a "packing station," generally designated 90 (Step 508). The term "packaging station" is defined herein as a table, counter or other surface or area that is conducive to creating and/or filling a package 92, 92' (FIGS. 16-18 and 19A). It is understood that the packing station 90 may be the same area, location and/or work surface where each container 10 is filled with a desired medicine, closed and/or labeled. Once the two or more child-resistant containers 10 arrive at the packing station 90, it is preferred that each group of containers 10 constitute an order, such as a patient's order or a pharmacy's order, for example, are properly collated or organized (Step 510).

Figure 11:
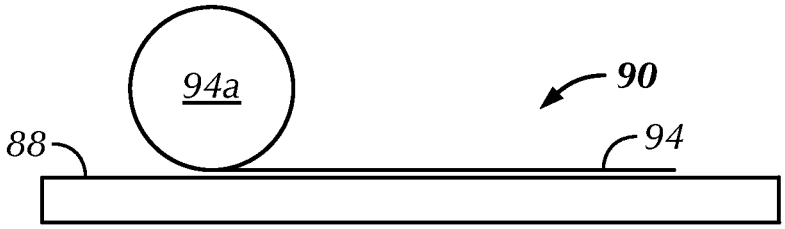
FIG. 11 is a schematic view of one step of the method shown in FIG. 10.

The packing station 90 preferably includes the movable conveyor belt or work surface 88, such as a table or countertop, to allow for the formation of the flat-rate shipping package 92, 92'. As shown in FIG. 11, a preferably continuous sheet of plastic wrap or other packaging material 94 (also referred to herein as the "first packaging material") is preferably rolled out or laid flat along a top surface of the conveyor belt or work surface 88 (Step 512). The first packaging material 94 may be pre-cut to the necessary size for each specific order, or the first packaging material 94 may be cut to the necessary size once it is laid out on top of the conveyor belt or work surface 88. The first packaging material 94 may be dispensed onto the conveyor belt or work surface 88 via an automated process, such as unrolled from a drum 94*a* by a machine or robot, or manually by an individual.

Figure 12:
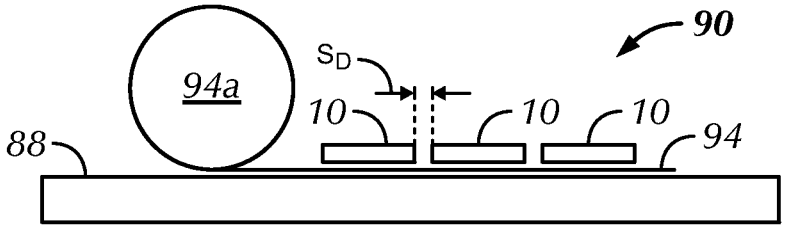
FIG. 12 is a schematic view of another step of the method shown in FIG. 10.

As shown in FIG. 12, the appropriate number of child resistant containers 10 filled with medicine are placed onto a top surface of the first packaging material 94 such that one of the front and rear sidewalls 20, 22 of the bottom segment 16 extends generally parallel with and is in facing engaging contact with the top surface of the plastic wrap 94 (Step 514). Next, the child-resistant containers 10 are preferably properly aligned and spaced-apart to the required predetermined distance $S_D$ to conform to carrier requirements for flexible packages (Steps 516). Again, the above steps can be performed by an automated process, such as by a robot, or manually by an individual.

Figure 13:
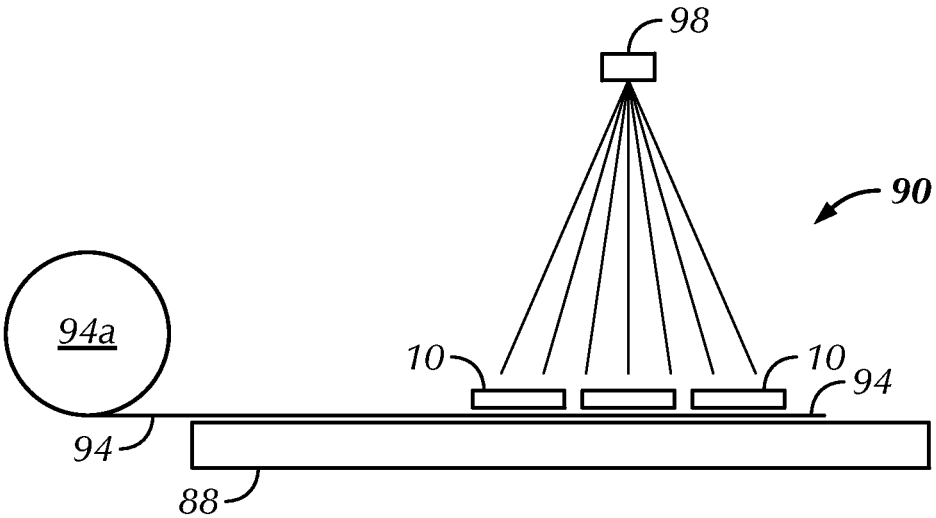
FIG. 13 is a schematic view of another step of the method shown in FIG. 10.
Figure 14:
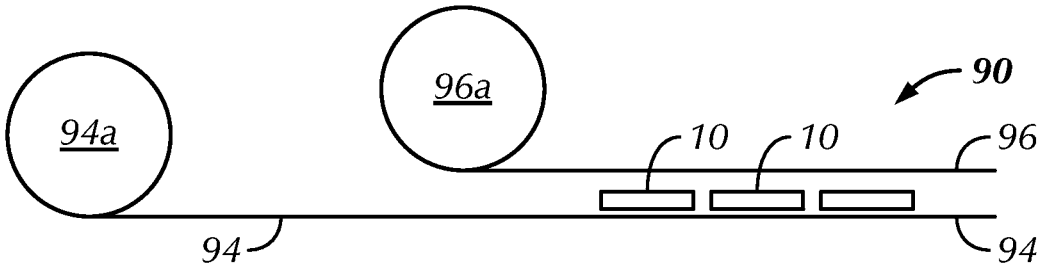
FIG. 14 is a schematic view of another step of the method shown in FIG. 10.

As shown in FIG. 13, once the child-resistant containers 10 are properly spaced and/or aligned, it is preferred that a scanner 98, such as an overhead bar code scanner, reads or deciphers each label on each container 10 and confirms the accuracy of the order (Step 518). As shown in FIG. 14, the properly aligned and/or spaced child-resistant containers 10 are then preferably conveyed through an overwrap machine such that a second plastic wrap or other packaging material 96 (also referred to herein as the "second packaging material") is laid across the child-resistant containers 10 opposite from the first packaging material 94 (Step 520). Alternatively, instead of employing an overwrap machine, the top or second plastic packaging material 96 may be unrolled or laid out via a dispensing drum 96*a* or manually by an individual, for example.

Figure 15:
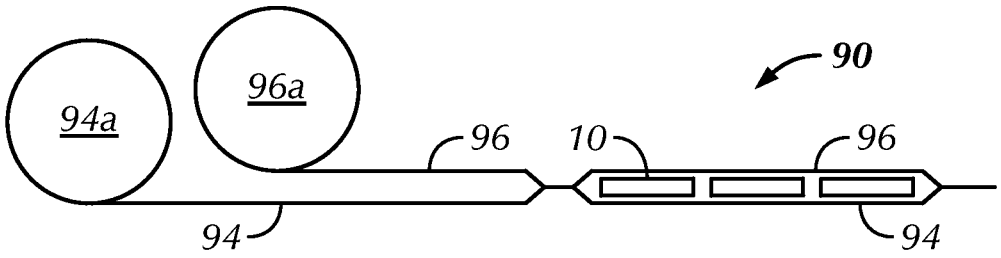
FIG. 15 is a schematic view of another step of the method shown in FIG. 10.
Figure 16:
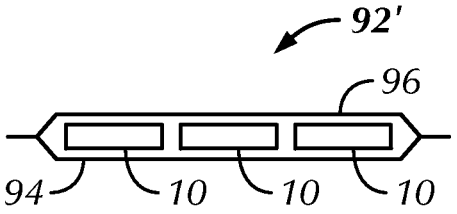
FIG. 16 is a schematic view of another step of the method shown in FIG. 10.
Figure 17:
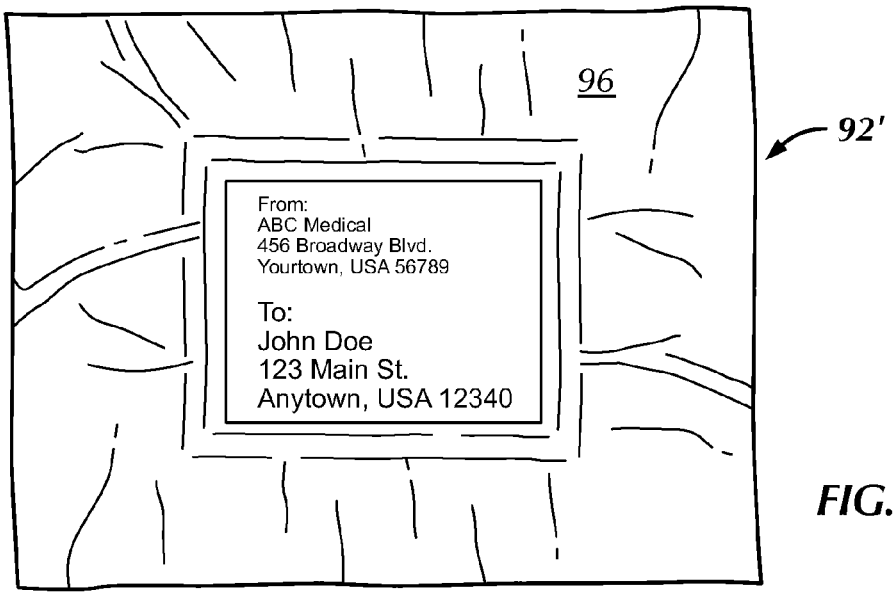
FIG. 17 is a top plan view of a package for shipping a single child-resistant medicate container in accordance with a preferred embodiment of the present invention, with certain portions of a label on the package redacted.
Figure 18:
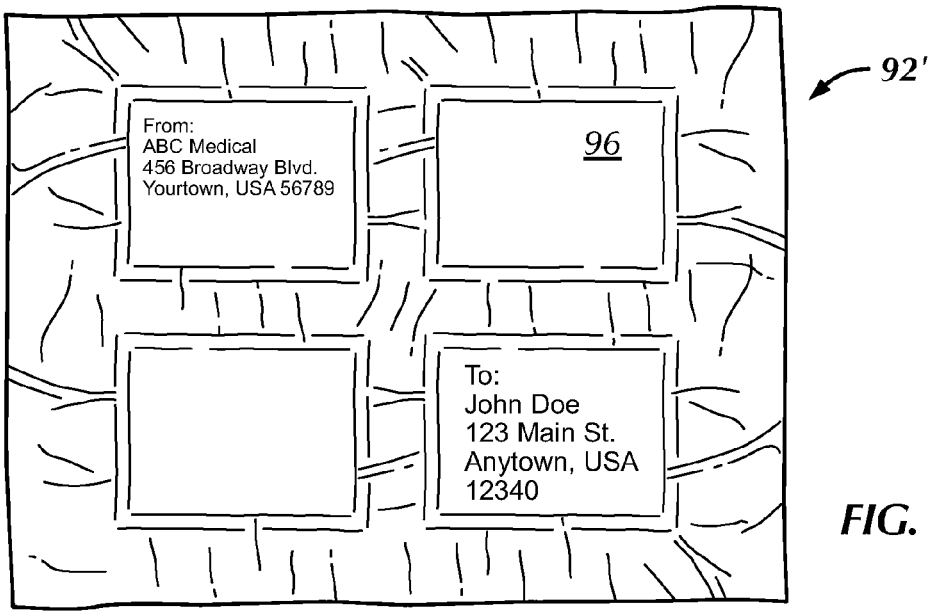
FIG. 18 is a top plan view of a package for shipping two or more child-resistant medicate containers in accordance with another preferred embodiment of the present invention, with certain portions of a label on the package redacted.
Figure 19A:
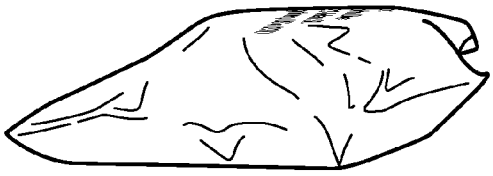
FIG. 19A Prior Art
FIG. 19A is a side elevational view of a prior art package for shipping at least one conventional cylindrical medicate container.
Figure 19B:
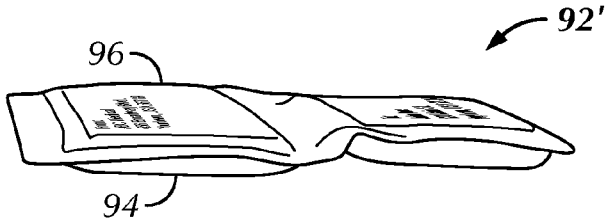
FIG. 19B is a side elevational view of the package shown in FIG. 18.

Next, as shown in FIG. 15, it is preferred that portions of the second (i.e., top) and first (i.e., bottom) packaging materials 96, 94 that extend beyond the outer edges of the adjacent child-resistant containers 10 are sealed together to form a cavity that houses or surrounds the child-resistant containers 10 (Step 522). The combined or sealed top and bottom packaging materials 96, 94 are then cut such that specified selvage remains on the outer ends of the newly formed package to conform to carrier requirements (Step 524). It is preferred that the cavity formed and sealed between the top and bottom packaging materials 96, 94 is at least generally air tight. However, the flat-rate package 92, 92' described above is not so limited. Finally, as shown in FIG. 16, it is preferred that a shipping or other information label is printed and applied to an exterior surface of the flat-rate package 92 (Step 526) and the package 92, 92' is then provided to a carrier for shipment to a patient or pharmacy, for example. As shown when comparing FIGS. 19A and 19B, the package 92, 92' described above is substantially thinner than a package (FIG. 19A) for shipping conventional, circular medical containers (not shown). The reduced thickness of the package 92, 92' provides for substantial savings in shipping costs.

The above-described packaging and/or shipping process is not limited to each of the above-identified steps, or to the order specified above. For example, the flat-rate package 92, 92' may first be formed without sealing every edge of the package 92, 92' so that the at least two medical containers 10 may be inserted into an open end of the package 92, 92' such that adjacent right and left sidewalls 24, 26 or top and bottom ends 58, 30 of the containers 10 are generally parallel and/or in abutting contact. Alternatively, the at least two medical containers 10 may be inserted within an open end of the package 92, 92' such that generally the entire front and rear sidewalls of each container 10 is placed in abutting contact with an interior surface of the package 92, 92'. In such an embodiment, the open end of the package 92, 92' is then closed or sealed to enclose the at least two containers 10 within the package 92, 92'. Finally, the closed or sealed package 92, 92' may be given to the carrier and a relatively inexpensive and flat-rate fee is paid to the carrier to ship the package 92, 92' containing the child-resistant containers 10 to an end user or distributer. It is understood that the package 92, 92' may be sized and/or shaped to enclose any number of containers 10 and multiple packages may be formed, filled and/or shipped at one time. For example, the package 92 may enclose only a single container 10 (see FIG. 17), or the package 92' may enclose two or more, such as four spaced-apart, containers 10 (see FIG. 18), wherein each container 10 is spaced-apart and separated from an adjacent container 10 by a seal.

In addition, the container 10 of the present invention provides for a method of filling/packing a child-resistant container 10 with at least one item, such as a medicate or pharmaceutical product. The method encompasses either automatic or manual filling of the container 10. The method comprises the steps of providing a child-resistant container 10, generally as described in detail above. Next, the base segment 16 of the housing 12 is placed onto an assembly or product line. Next, at least one item, such as a medicate or pharmaceutical product, is inserted into the storage cavity 14 via the open first end 42 of the insert segment 18 of the housing 12. Finally, the cover 48 is movably mounted over at least a portion of the insert segment 18 of the housing 12. In an assembled configuration, the container 10 provides a generally air and/or water impermeable container 10 that is capable of storing and/or transporting a variety of pharmaceutical products.

Referring to FIGS. 20-23, a second preferred embodiment of the container 110 is shown, wherein like referenced numerals are utilized to indicate like elements throughout. The reference numerals of the second preferred embodiment are distinguishable from those of the first preferred embodiment by a factor of one hundred (100). The container 110 of the second preferred embodiment is substantially similar to that of the first preferred embodiment. For example, the container 110 includes a housing 112, preferably comprised of a base segment 116 having a front sidewall 120 and a left sidewall 126, an insert segment 118 having a front sidewall 132 and a left sidewall 138, and a cover 148 slidably, but not removably, mounted thereto. Additional similarities between the first and second preferred embodiments are omitted herein for the sake of brevity and convenience, and is are not limiting.

Figure 23:
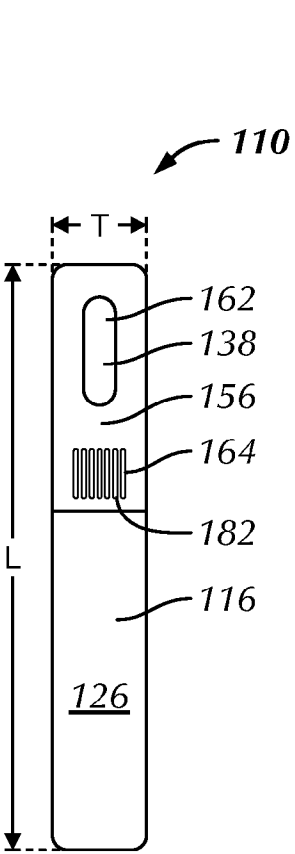
FIG. 23 is a left side elevational view of the child-resistant medicate container shown in FIG. 20, with the cover shown in a first or storage position.
Figure 22:
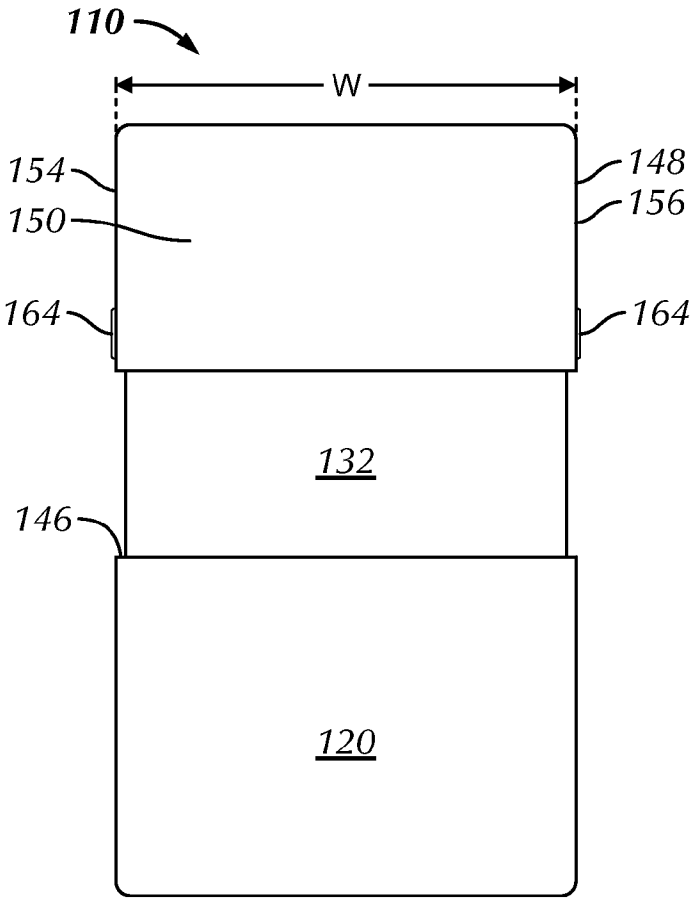
FIG. 22 is a front elevational view of the child-resistant medicate container shown in FIG. 20.
Figure 21:
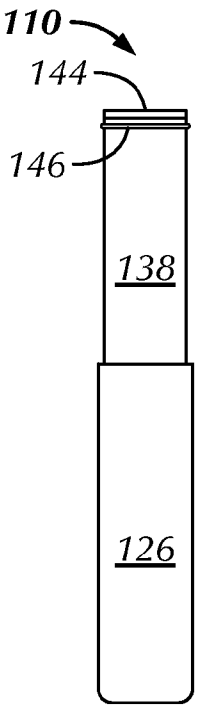
FIG. 21 is a left side elevational view of a housing of the child-resistant medicate container shown in FIG. 20.
Figure 20:
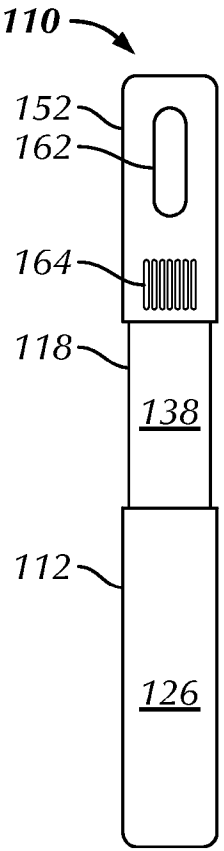
FIG. 20 is a left side elevational view of a child-resistant medicate container in accordance with a second preferred embodiment of the present invention, with a cover of the container shown in a second or dispensing position.

A primary difference between the first and second preferred embodiments is the structure and operation of the locking mechanism 164 of the second preferred embodiment. Specifically, in the present embodiment, the locking mechanism 164 is integrally or fixedly formed with at least one, but preferably both, the right and left sidewalls 154, 156 of the cover 148. An exterior surface of each locking mechanism 164 includes a plurality of spaced-apart ribs 182 that extend generally parallel to the front and rear sidewalls 150, 152 of the cover 148. The plurality of ribs 182 increase the friction between a users thumb/finger and the cover 148 when the user is attempting to slide the cover 148 with respect to the housing 112. In addition, an interior surface of the cover 148 may include a catch or hook (not shown) to generally engage a portion of the housing 112 in the second or storage position (FIG. 23). However, one skilled in the art would understand that the cover 148 and housing 112 may be secured to each other by a variety of other well known fastening methods, such as an interference or friction fit, screws, adhesives or the like. In addition, those skilled in the art will understand from the present disclosure that the locking mechanism 164 may be one of a variety of well known latching devices, such as a slider or a snap without departing from the spirit and scope of the invention.

In operation, the user depresses the locking mechanism 164 toward a geometric center of the container 110, such that the catch or hook of the cover 148 is released from a complimentary ledge or protuberance (not shown) on the housing 112. At this point, the cover 148 is generally freely slidable over at least a portion of the insert segment 118 to either dispense at least one item from an aperture 162 of the cover 148 or safely enclose the at least one item within the container 110.

Figure 24:
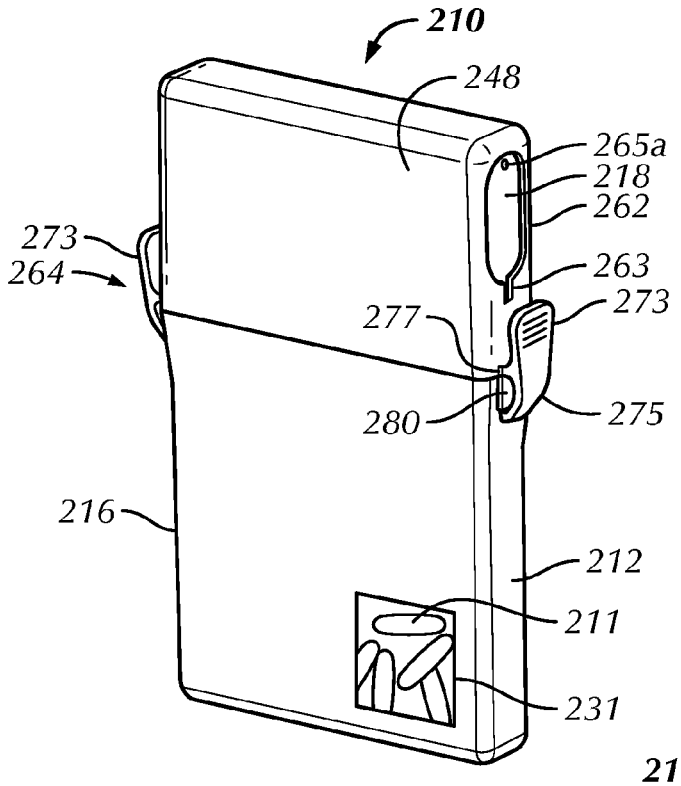
FIG. 24 is a perspective view of a child-resistant medicate container in accordance with a third preferred embodiment of the present invention, with a cover of the container shown in the first or storage position.
Figure 25:
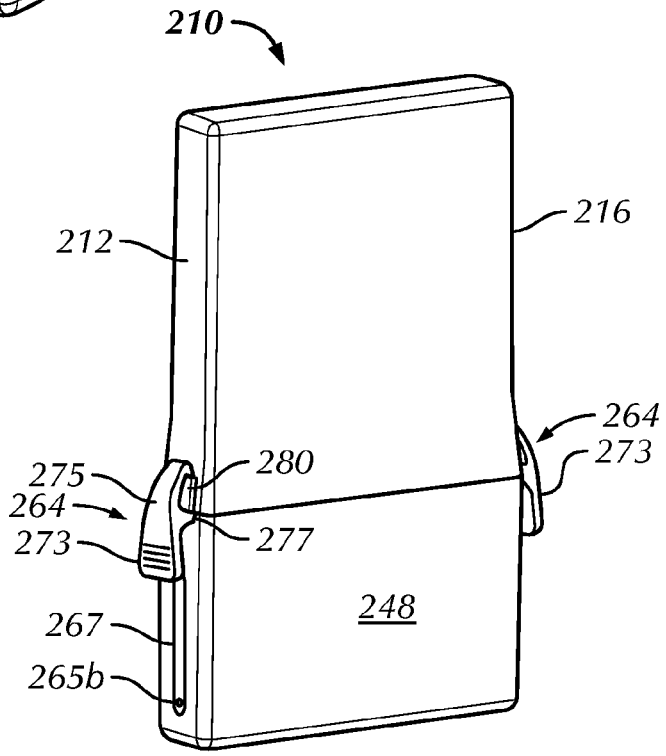
FIG. 25 is a respective view of the child-resistant medicate container shown in FIG. 24 in an inverted position, with the cover of the container shown in the first or storage position.

Referring to FIGS. 24 and 25, a third preferred embodiment of the container 210 is shown, wherein like referenced numerals are utilized to indicate like elements throughout. The reference numerals of the second preferred embodiment are distinguishable from those of the first preferred embodiment by a factor of two hundred (200). The container 210 of the third preferred embodiment is substantially similar to that of the first and second preferred embodiments. For example, the container 210 includes a housing 212, preferably comprised of a base segment 216 and an insert segment 218, and a cover 248 slidably, but not removably, mounted thereto. Additional similarities between the preferred embodiments are omitted herein for the sake of brevity and convenience, and is not limiting.

A distinguishing feature of the third preferred embodiment, as compared to the first and second preferred embodiments, is the size, shape and operation of a locking mechanism 264. It is preferred that one of the base segment 216 and the insert segment 218 includes a tab or catch 280 the extends outwardly or perpendicularly therefrom, and the other of the base segment 216 and the insert segment 218 includes a gripping portion 273 and a hook portion 275 that are selectively pivotable about a hinge 277, such as a living hinge. It is preferred that selective depression of the gripping portion 273 pivots the gripping portion 273 toward the base segment 216 or the insert segment 218, which in turn causes the hook portion 275 to pivot away from the base segment 216 or the insert segment 218 so as to engage or disengage the catch 280.

Further, as shown in FIG. 24, an aperture or opening 262 formed in a sidewall of the cover 248 preferably includes a groove or notch 263 that extends outwardly beyond a periphery of the aperture 262. In other words, the groove 263 disrupts the generally smooth or continuous outer periphery of the aperture 262 and extends further into the sidewall of the cover 248. The groove 263 is preferably sized and shaped to selectively receive a portion of a first projection **265*a* that extends outwardly at least slightly beyond a sidewall of the insert segment 218. The first projection 265*a* is preferably positioned or located at or proximate the upper open end of the base segment 218. The groove 263 is sized and shaped to receive at least a portion of the first projection 265*a* therein when the cover 248 is in the open second position (not shown in FIGS. 24 and 25, but see the position shown in FIG. 5). In other words, the engagement between the first projection 265*a* and the groove 263 at least helps to prevent the cover 248 from being completely removed and/or separated from the insert segment 218**.

As shown in FIG. 25, it is preferred that a sidewall of the cover 248 opposite the aperture 262 includes a generally elongated slot 267 therein that preferably extends completely through the sidewall. A length of the slot 267 is preferably significantly greater than a width of the slot 267. The slot 267 is preferably sized and shaped to selectively receive a portion of a second projection **265*b* that extends outwardly at least slightly beyond a sidewall of the insert segment 218. The second projection 265*b* is preferably positioned or located at or proximate the upper open end of the base segment 218. The combination of the groove 263 and the first projection 265*a*, and the slot 267 and the second projection 265*b*, preferably limit the range of motion or travel of the cover 248 with respect to the housing 212**.

The container 210 of the third preferred embodiment also preferably includes a window 231 formed in the base segment 216. The window 231 is preferably formed of at least a generally transparent or translucent material, such as a polymeric material, so as to allow a user or pharmacist, for example, to visually identify the size, shape and/or type of medicate 211 within the container 210. The window 231 is preferably included in an embodiment wherein the remainder of the base segment 216 is at least generally opaque or at least the remainder of the base segment 216 is covered by one or more labels. As shown in FIG. 24, the window 231 is preferably square in shape, located in a lower right corner of the front sidewall of the base segment 216, and is sufficiently sized to allow a user to view multiple medicate therein simultaneously. However, the window 231 is not limited to the above configuration. The window 231 is preferably located in a lower right corner of the front sidewall of the base segment 216 so as to maintain as large of a contiguous area as possible on the front sidewall of the base segment 216 to receive one or more labels.

Figure 26:
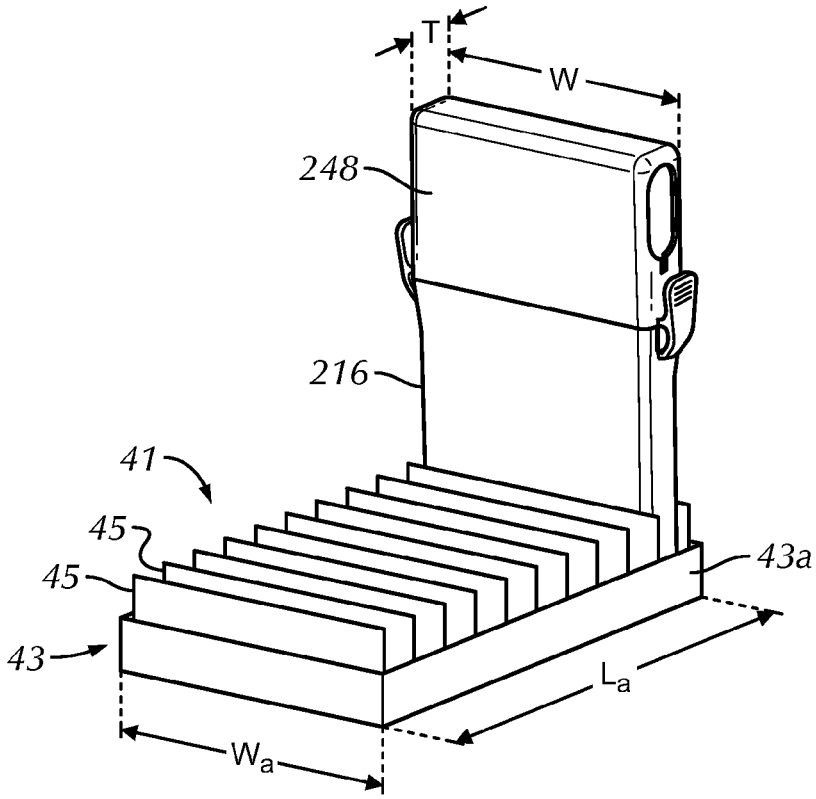
FIG. 26 is a perspective view of a combination of the child-resistant medicate container shown in FIG. 24 and an apparatus for supporting the container in accordance with a preferred embodiment of the present invention.
Figure 27:
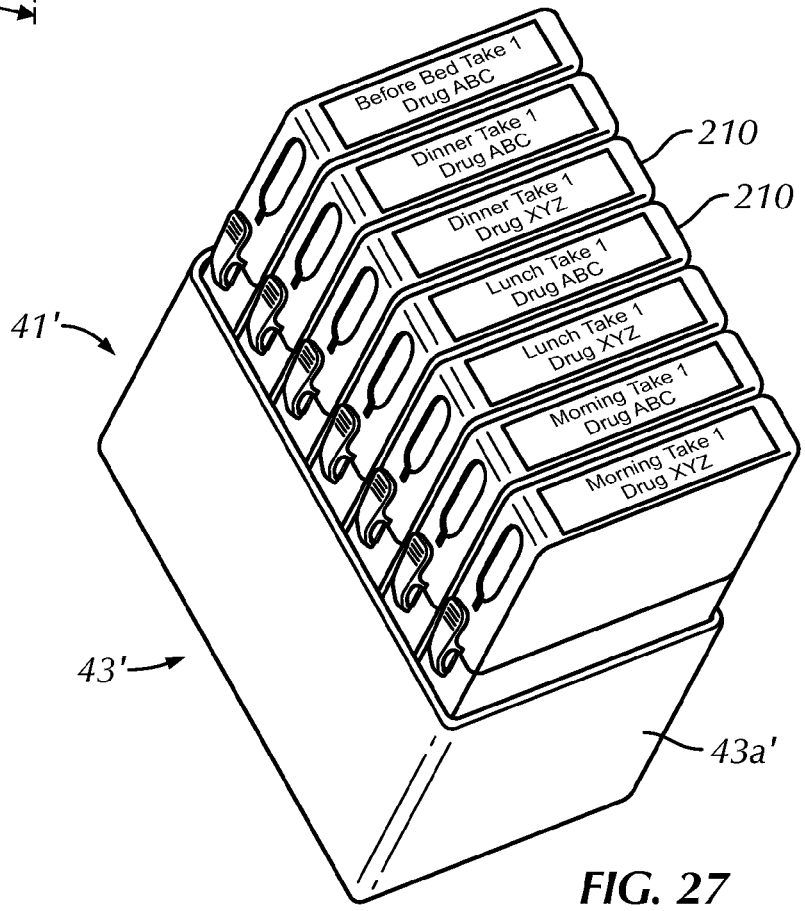
FIG. 27 is a perspective view of a combination of a plurality of the child-resistant medicate containers shown in FIG. 24 and a modified version of the apparatus for supporting the containers in accordance with a preferred embodiment of the present invention.

Referring to FIGS. 26 and 27, preferred embodiments of a support rack or holder 41, 41' are shown in combination with one or more of the child-resistant medicate containers 210 of the third preferred embodiment. The support racks 41, 41' are each sized, shaped and/or configured to support at least one and preferably a plurality of the child-resistant medicate containers 210 in a generally side-by-side and vertical, upright configuration. As shown in FIG. 26, a first preferred embodiment of the support rack 41 includes a generally rectangular base 43 having a bottom wall (not shown) and a sidewall 43*a* extending perpendicularly upwardly from the bottom wall around a periphery of the base 43.

At least one and preferably a plurality of spaced-apart dividers 45 extend across a width $W_a$ of the base 43. The width $W_a$ of the base 43 is preferably at least slightly greater than the width W of one of the containers 210, so that the base 43 can accommodate the containers 210 therein. Each divider 45 is spaced-apart a predetermined distance along a length $L_a$ of the base 43 from an adjacent divider 45 and/or a portion of the sidewall 43*a* that forms an end wall of the base 43. The predetermined distance is preferably at least slightly larger than the thickness T of each container 210, so that a single container 210 can be inserted between adjacent dividers 45. The dividers 45 preferably contact or engage at least a portion of the containers 210 to provide structural support to maintain the containers 210 in the vertical or upright configuration. Each divider 45 preferably extends from the bottom wall of the base 43 to a height above a top surface of the sidewall 43*a* of the base 43. The dividers 45 may be integrally or unitarily formed with the base 43, or removably insertable into the base 43, such as in slots or guide rails (not shown) formed on an interior surface of at least a portion of the sidewall 43*a* of the base 43.

As shown in FIG. 27, the base 43' of the second preferred embodiment of the support rack 41' preferably includes a bottom wall (not shown) and a sidewall 43*a'* extending upwardly perpendicularly from the bottom wall around a periphery of the base 43'. The sidewall 43*a'* of the second preferred embodiment preferably extends to a height generally equal to the height of the base segment 216 of the container 210. The base 43' preferably forms a cavity that is slightly larger than ten (10) containers 210 arranged in a side-by-side configuration (see FIG. 27), so that ten (10) containers 210 may be removably insertable into the base 43' simultaneously, if desired.

In the second preferred embodiment of the support rack 41', a top surface of the cover 248 of each container 210 preferably includes a unique label, which preferably identifies the type, amount and time of day a particular drug contained within the container 210 should be taken by a patient. For example, the cover 248 of one container 210 may provide the type of medicate contained in that particular container 210, along with instructions for the amount and time of day (i.e., breakfast, lunch or dinner) that particular medicate is to be consumed by the patient. The cover 248 of an adjacent container 210 may provide the type of medicate container in that particular container 210, which is different from the medicate described in the adjacent container 201, along with instructions for the amount and time of day that particular medicate is to be consumed by the patient. The labeling configuration described above provides a simple and easy-to-follow method of establishing a self-administration method of a patient's daily medicate needs.

Figure 28:
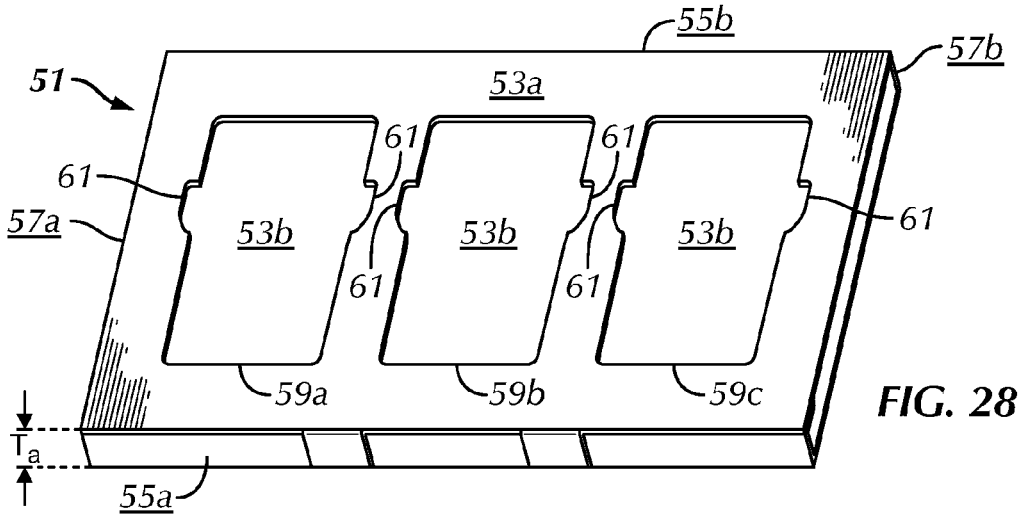
FIG. 28 is a perspective view of an apparatus for shipping or transporting at least one child-resistant medicate container in accordance with a preferred embodiment of the present invention.
Figure 29:
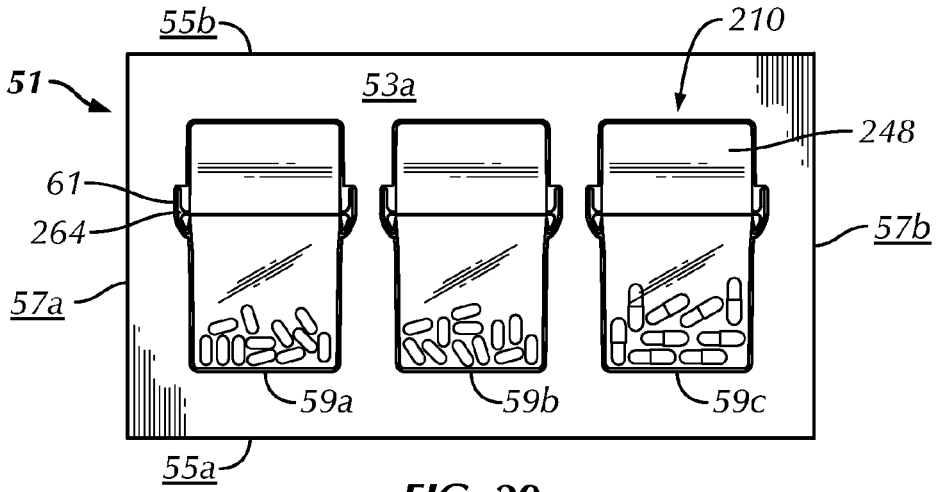
FIG. 29 is a perspective view of the apparatus shown in FIG. 28, with three child-resistant medicate containers of FIG. 24 therein.
Figure 30:
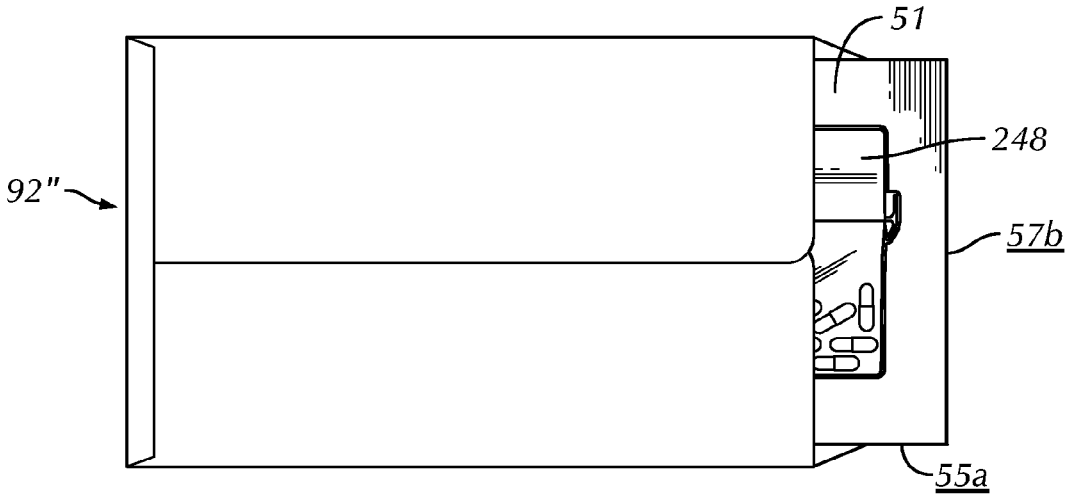
FIG. 30 is a perspective view a portion of the apparatus of FIG. 28 extending outwardly from a flat-rate envelope.

FIGS. 28-30 show a preferred embodiment of an apparatus 51 for shipping or transporting at least one of the child-resistant medicate containers 210 of the third preferred embodiment via a carrier at a flat rate. The apparatus 51 is preferably a disposable, reusable or recyclable frame, casing or support for properly spacing, aligning and/or configuring the containers 210 to conform to the carrier's requirements for shipping at the flat rate. The apparatus 51 may be formed of corrugated and/or fluted cardboard that is designed to be selectively foldable from a completely flat configuration (not shown) to a folded configuration forming a cavity shown in FIG. 28. However, the apparatus 51 is not limited to the above configuration. For example, the apparatus 51 may simply be a generally flat structure that does not require folding to be used as intended. Alternatively, the apparatus 51 may be an inflatable casing or bag, such as an "air bag" formed of a polymeric material, that also provides increased cushioning and/or protection to the child-resistant medicate container(s) 210 therein.

The apparatus 51 preferably includes a first or top surface 53*a* and an opposing second or bottom surface 53*b*. In the cardboard embodiment, the top and bottom surfaces 53*a*, 53*b* may each define a plane such that the plane of the top surface 53*a* and the plane of the bottom surface 53*b* preferably extend generally parallel to each other when the apparatus 51 is in the folded configuration (FIGS. 28-30). The top and bottom surfaces 53*a*, 53*b* are spaced-apart a predetermined distance so that the apparatus 51 has a predetermined thickness, which may be the same as, less than or greater than the thickness T of the container 210, but preferably is less than the thickness T of the container 210. In the air bag embodiment, the top and bottom surfaces 53*a*, 53*b* may also be generally flat or planar, as described above with respect to the cardboard embodiment, but may also have a slight convexity due to the inflatable nature of the embodiment. Nevertheless, in the air bag embodiment, the top and bottom surfaces 53*a*, 53*b* of the apparatus 51 extend generally parallel to one another.

The apparatus 51 also preferably includes a first or front sidewall 55*a* and an opposing second or rear sidewall 55*b*. In the cardboard embodiment, the front and rear sidewalls 55*a*, 55*b* may each define a plane such that the plane of the front sidewall 55*a* and the plane of the rear sidewall 55*b* preferably extend generally parallel to each other. The planes defined by the front and rear sidewalls 55*a*, 55*b* preferably extend generally perpendicularly to the planes defined by the top and bottom surfaces 53*a*. Further, the apparatus 51 includes a third or right sidewall 57*a* and an opposing fourth or left sidewall 57*b*. The right and left sidewalls 57*a*, 57*b* each define a plane such that the plane of the right sidewall 57*a* and the plane of the left sidewall 57*b* preferably extend generally parallel to each other. The planes defined by the right and left sidewalls 57*a*, 57*b* preferably extend generally perpendicularly to the planes defined by the top and bottom surfaces 53*a*, 53*b* and the front and rear sidewalls 55*a*, 55*b*. Again, the sidewalls 55*a*, 55*b*, 57*a*, 57*b* of the air bag embodiment also extend generally parallel to one another, as described above with respect to the cardboard embodiment, but the sidewalls 55*a*, 55*b*, 57*a*, 57*b* of the air bag embodiment may also be at least slightly convex.

As shown in FIG. 28, at least one opening 59*a* preferably extends completely through the top surface 53*a* of the apparatus 51. The at least one opening 59*a* is preferably sized and shaped to receive at least a portion of at least one child-resistant medicate container 210 therein (see FIGS. 29 and 30). More specifically, the apparatus 51 includes at least three laterally spaced-apart openings 59*a*, 59*b*, 59*c* that extend completely through the top surface 53*a* thereof. In the cardboard embodiment, each opening 59*a*, 59*b*, 59*c* may also extend completely through the bottom surface 53*b* of the apparatus 51, so that each opening 59*a*, 59*b*, 59*c* extends completely through the apparatus 51. In the air bag embodiment, each opening 59*a*, 59*b*, 59*c* may form a recess, depression or slot that extends below the top surface 53*a*.

Each opening 59*a*, 59*b*, 59*c* is preferably sized and shaped to receive and surround one container 210 around the periphery thereof. Each opening 59*a*, 59*b*, 59*c* preferably includes four (4) generally straight edges, wherein adjacent edges extend generally perpendicularly to one another. At least two of the straight edges of each opening 59*a*, 59*b*, 59*c* extend generally parallel to the right and left sidewalls of the container 210 and include a recess 61 that is sized and shaped to receive at least a portion of the locking mechanism 264 of container 210. Each opening 59*a*, 59*b*, 59*c* is preferably slightly smaller than a silhouette defined by each container 210, such that each opening 59*a*, 59*b*, 59*c* frictionally engages at least a portion of the periphery of the container 210 so as to generally hold the container 210 in place.

In operation, a user or manufacturer, for example, obtains the apparatus 51, folds the apparatus 51 to the configuration shown in FIG. 28, or inflates the apparatus 51. After the child-resistant medicate container 210 are filed with the desired type and amount of medicate, each container 210 is preferably inserted into one of the openings 59*a*, 59*b*, 59*c* of the apparatus 51. At least a portion of each container 210, such as the front sidewall of the container 210, may extend perpendicularly outwardly beyond at least the top surface 53*a* of the apparatus 51 when the containers 210 are inserted into the openings 59*a*, 59*b*, 59*c* (see FIGS. 29 and 39). Further, at least a portion of the rear sidewall of each container 210 may extend perpendicularly outwardly beyond at least the bottom surface 53*b* of the apparatus 51 when the containers 210 are inserted into the openings 59*a*, 59*b*, 59*c*. Next, it is preferred that the combined apparatus 51 and containers 210 are inserted into a flat-rate envelope or package 92" provided by the carrier, and the package 92" is then preferably closed or sealed to enclose the combined apparatus 51 and containers 210 therein.

The combined apparatus 51 and package 92", which space-apart the containers 210 therein, have the necessary flexibility to withstand the rigors of shipment or transportation. The apparatus 51, one or more of the containers 210 and the package 92" is machineable as a generally flat combination having a thickness $T_a$ of less than or approximately one half (½) inch (see FIG. 28). The combination is capable of being at least slightly bent and/or resilient so as to conform to various corners or edges, such as that of a table, for example or a mail slot. The combination is sufficiently sized and/or shaped to fit relatively easily through a standard mail slot, such as that typically found in a door of a home or office building. The apparatus 51 also provides cushioning and protection to both the one or more containers 210 therein and the package 92". The apparatus 51 also prevents the containers 210 from bumping together or engaging one another during transportation or shipment of the package 92", and prevents unnecessary or undesirable expansion of the package 92" by evenly spacing the containers 210 therein. The package 92" that surrounds and/or encloses the apparatus 51 and container (s) 210 provides a uniform appearance, which is required by many carrier regulations.

Those skilled in the art will appreciate that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of shipping at least one child-resistant medicate container via a carrier at a flat rate, the method comprising:

a) providing or obtaining at least one child-resistant medicate container including a housing defining a front sidewall, an opposing rear sidewall, a right sidewall, an opposing left sidewall, the at least one child-resistant medicate container further including at least one locking mechanism, each of the front and rear sidewalls defining a plane such that the plane of the front sidewall and the plane of the rear sidewall extend generally parallel to each other, each of the right and left sidewalls defining a plane such that the plane of the right sidewall and the plane of the left sidewall extend generally parallel to each other, the right sidewall extending generally perpendicularly to the front sidewall, a cover being slidably attached to the housing and surrounding at least a portion of each of the front, rear, right and left sidewalls of the housing, the at least one locking mechanism including a gripping portion pivotably attached to one of the housing and the cover by a hinge, the gripping portion being selectively pivotable toward and away from at least one of the housing and the cover to disengage and engage, respectively, the at least one locking mechanism;

b) creating or obtaining a flat-rate shipping package from a carrier;

c) inserting the at least one child-resistant medicate container into the package;

d) closing the package to enclose the at least one child-resistant medicate container within the package so that the package is generally flat and satisfies a requirement of the carrier for flat-rate shipping; and e) shipping or transporting the closed package by the carrier at the flat-rate.

2. The method according to claim 1, further comprising:

filling the at least one child-resistant medicate container with a specified type and specified amount of medicate prior to inserting the at least one child-resistant medicate container into the package.

3. The method according to claim 1, further comprising:

applying at least three distinct labels to at least a portion of at least one of the front and rear sidewalls of the at least one child-resistant medicate container prior to inserting the at least one child-resistant medicate container into the package, wherein each label is placed at a separate location on at least a portion of the at least one of the front and rear sidewalls so the labels do not overlap on the at least one child-resistant medicate container.

4. The method according to claim 1, wherein the cover includes an aperture formed in a sidewall thereof, the cover being movable between a first position in which the aperture is substantially blocked to prevent at least one medicate from being dispensed from the at least one child-resistant medicate container and a second position in which the aperture is at least partially open to allow the at least one medicate to be dispensed from the at least one child-resistant medicate container.

5. The method according to claim 1, wherein the housing includes a window formed of a transparent or translucent material, and wherein a remainder of the housing and the cover are formed of an opaque material.

6. A method of shipping at least two child-resistant medicate containers via a carrier at a flat rate, the method comprising:

a) providing or obtaining at least two child-resistant medicate containers, each container including a front sidewall, an opposing rear sidewall, a right sidewall, an opposing left sidewall, and at least one locking mechanism, each of the front and rear sidewalls defining a plane such that the plane of the front sidewall and the plane of the rear sidewall extend generally parallel to each other, each of the right and left sidewalls defining a plane such that the plane of the right sidewall and the plane of the left sidewall extend generally parallel to each other, the right sidewall extending generally perpendicularly to the front sidewall;

b) at least partially filling each of the at least two child-resistant medicate containers with a specified type and specified amount of medicate;

c) dispensing or laying a first packaging material on a surface;

d) placing each of the at least two child-resistant medicate containers onto the first packaging material following step c);

e) spacing apart each of the at least two child-resistant medicate containers on the first packaging material by a predetermined distance following step d);

f) dispensing or laying a second packaging material to at least partially cover each of the at least two child-resistant medicate containers between the first and second packaging material following step e);

g) sealing the first and second packaging material together to form a closed package that encloses each of the at least two child-resistant medicate containers therebetween following step f; and h) sending the closed package by the carrier at the flat-rate.

7. The method according to claim 6, further comprising:

cutting or trimming excess packaging material that extends outwardly beyond a seal of the package prior to sending the closed package by the carrier at the flat-rate.

8. The method according to claim 6, further comprising:

applying at least one label to at least a portion of at least one of the front and rear sidewalls of the at least two child-resistant medicate containers immediately prior to or immediately following at least partially filling each of the at least two child-resistant containers.

9. The method according to claim 6, wherein the closed package includes four spaced-apart child-resistant medicate containers, and wherein each child-resistant medicate container is spaced-apart from an adjacent child-resistant medicate container by a seal.

10. A method of shipping at least two child-resistant medicate containers via a carrier at a flat rate, the method comprising:

a) providing or obtaining at least two child-resistant medicate containers, each container including a front sidewall, an opposing rear sidewall, a right sidewall, an opposing left sidewall, and at least one locking mechanism, each of the front and rear sidewalls defining a plane such that the plane of the front sidewall and the plane of the rear sidewall extend generally parallel to each other, each of the right and left sidewalls defining a plane such that the plane of the right sidewall and the plane of the left sidewall extend generally parallel to each other, the right sidewall extending generally perpendicularly to the front sidewall;

b) at least partially filling each of the at least two child-resistant medicate containers with a specified type and specified amount of medicate;

c) providing or obtaining a frame having at least two laterally spaced-apart openings, each opening being at least slightly smaller than an outer periphery of each medicate container such that each opening frictionally engages one of the child-resistant medicate containers to generally hold the child-resistant medicate container in place;

d) inserting each of the at least two child-resistant medicate containers into one of the openings of the frame following step c) such that at least a portion of one of the front and rear sidewalls of each child-resistant medicate container extends outwardly beyond a front sidewall of the frame;

e) inserting the frame into a flat-rate envelope or container provided by the carrier following step d);

f) closing the envelope or container to enclose the frame therein following step e);

g) sending the closed package by the carrier at the flat-rate.

11. The method according to claim 10, wherein during step c) the frame is folded from a flat configuration to a folded configuration to form a cavity.

12. The method according to claim 11, wherein each opening has a shape that matches a silhouette of each child-resistant medicate container.

* * * * *